US012297733B2

(12) United States Patent
Wang et al.

(10) Patent No.: US 12,297,733 B2
(45) Date of Patent: May 13, 2025

(54) AZIMUTHAL SCANNING OF A WELLBORE FOR DETERMINATION OF A CEMENT-BOND CONDITION AND FOR DETECTING/LOCATING A LEAK SOURCE

(71) Applicant: Halliburton Energy Services, Inc., Houston, TX (US)

(72) Inventors: Ruijia Wang, Singapore (SG); Yao Ge, Singapore (SG); Jing Jin, Singapore (SG); Xiang Wu, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 777 days.

(21) Appl. No.: 16/905,416

(22) Filed: Jun. 18, 2020

(65) Prior Publication Data

US 2021/0396126 A1 Dec. 23, 2021

(51) Int. Cl.
*E21B 47/005* (2012.01)
*E21B 47/0228* (2012.01)
*E21B 47/13* (2012.01)

(52) U.S. Cl.
CPC ..... *E21B 47/005* (2020.05); *E21B 47/0228* (2020.05); *E21B 47/13* (2020.05)

(58) Field of Classification Search
CPC ..... E21B 47/00; E21B 47/005; E21B 47/02; E21B 47/022; E21B 47/0228;
(Continued)

(56) References Cited

U.S. PATENT DOCUMENTS 5,214,251 A 5/1993 Orban et al.
11,181,656 B2 * 11/2021 Syresin ..... G01V 1/50
(Continued)

FOREIGN PATENT DOCUMENTS

EP 3179277 A1 6/2017
WO 2004/057372 A1 7/2004
(Continued)

OTHER PUBLICATIONS

International Search Report and Written Opinion issued in related PCT Application No. PCT/US2021/021285 mailed Jun. 30, 2021, 13 pages.
(Continued)

*Primary Examiner* — Hoai-An D. Nguyen
(74) *Attorney, Agent, or Firm* — Kilpatrick Townsend & Stockton, LLP

(57) ABSTRACT

The present disclosure relates to determining a location of a noise source where the location includes azimuth information and determining cement-bond integrity. A downhole tool disposed in a borehole may comprise one or more receivers (such as a monopole receiver and any one or more of one or more multi-pole receivers) and in certain embodiments one or more transmitters that fire one or more shots may provide azimuthal estimate of the location of a noise source, a location of a leak in one or more layers of a casing, cement-bond integrity any combination thereof based, at least in part, on one or more measurements or data for received signals at any one or more receivers. Accurate and efficient identification of a leak or integrity of a cement-bond reduces overall inefficiencies and costs associated with a downhole operation.

20 Claims, 14 Drawing Sheets

(58) Field of Classification Search
CPC ..... E21B 47/10; E21B 47/107; E21B 47/13; E21B 47/12; E21B 47/26
USPC ..... 324/323, 345
See application file for complete search history.

(56) References Cited

U.S. PATENT DOCUMENTS

| | | | | |
|---|---|---|---|---|
| 2003/0018433 | A1 | 1/2003 | Blanch et al. | |
| 2003/0174581 | A1 | 9/2003 | Parra et al. | |
| 2006/0070433 | A1 | 7/2006 | Fredette et al. | |
| 2012/0075951 | A1* | 3/2012 | Johnson | G01V 1/46 367/32 |
| 2014/0043938 | A1 | 2/2014 | Sinha | |
| 2015/0168581 | A1 | 6/2015 | Izuhara et al. | |
| 2017/0226844 | A1 | 8/2017 | Izuhara et al. | |
| 2017/0350231 | A1* | 12/2017 | Merciu | E21B 47/005 |
| 2018/0003845 | A1* | 1/2018 | Sakiyama | E21B 47/085 |
| 2018/0284308 | A1* | 10/2018 | Hirabayashi | G01V 1/50 |
| 2019/0017369 | A1 | 1/2019 | Ameen | |
| 2019/0369285 | A1 | 12/2019 | Fouda et al. | |
| 2020/0072036 | A1 | 3/2020 | Wang | |
| 2020/0116007 | A1 | 4/2020 | Mandal | |

FOREIGN PATENT DOCUMENTS

| | | | |
|---|---|---|---|
| WO | 2016/187242 | A1 | 11/2016 |
| WO | 2020/047459 | A1 | 3/2020 |
| WO | 2020/149826 | A1 | 7/2020 |

OTHER PUBLICATIONS

Grosmangin, M., P. P. Kokesh, and Pd Majani. "A sonic method for analyzing the quality of cementation of borehole casings." Journal of Petroleum Technology 13.02 (1961): 165-171.

Kinoshita, Toshihiro, et al. "Feasibility and challenge of quantitative cement evaluation with LWD sonic." SPE Annual Technical Conference and Exhibition. Society of Petroleum Engineers, 2013.

Pistre, Vivian, et al. "Attenuation-Based Quantitative Cement Bond Index with LWD Sonic: A Novel Approach Applicable to all Casing and Cement Cases." SPE Annual Technical Conference and Exhibition. Society of Petroleum Engineers, 2014.

Izuhara, W., et al. "Full-range quantitative cement bond evaluation with LWD sonic: The right way of approach using a hybrid of amplitude and attenuation." SPE Annual Technical Conference and Exhibition. Society of Petroleum Engineers, 2017.

Tang, Xiaoming, Yuanda Su, and Bo Zhang. "A New Through-Casing Acoustic Logging Tool Using Dual-Source Transmitters." SPWLA 60th Annual Logging Symposium. Society of Petrophysicists and Well-Log Analysts, 2019.

Maslennikova, Yulia S., et al. "Spectral noise logging data processing technology." SPE Russian Oil and Gas Exploration and Production Technical Conference and Exhibition. Society of Petroleum Engineers, 2012.

Khalil, Ihab Nabil, et al. "Leak detection by temperature and noise logging." Abu Dhabi International Petroleum Conference and Exhibition. Society of Petroleum Engineers, 2012.

"Array Noise Tool (ANT)" Data Sheet, GoWellPro, found at https://static1.squarespace.com/static/5c5146db4eddecf7a88e4a5d/t/5d243a1d12c9e000010ce56d/1562655264082/WellIntegrity_ANT.pdf, Aug. 2017, 2 pages.

"Acoustic Conformance Xaminer® (ACX TM) Service" Data Sheet, Halliburton Well Assurance/Pipe Integrity, found at https://www.halliburton.com/content/dam/ps/public/lp/contents/Data_Sheets/web/H/Acoustic-Conformance-Xaminer.pdf?nav=en-US_wireline-perforating_public, Aug. 2016, 2 pages.

* cited by examiner

AZIMUTHAL SCANNING OF A WELLBORE FOR DETERMINATION OF A CEMENT-BOND CONDITION AND FOR DETECTING/LOCATING A LEAK SOURCE

BACKGROUND

The present disclosure generally relates to azimuthal scanning of source signals associated with a wellbore condition and in particular accurate processing or logging downhole source signals associated with a cement-bond along the wellbore or for detection of a leak, location of a leak or both.

Wellbores for hydrocarbon recovery are typically cased to ensure that the integrity of a wellbore is maintained during subsequent downhole operations. The cementing process involves mixing a slurry of cement, cement additives, and water, then pumping the mix down through the casing to the annulus which is the space formed between the casing and the wall of the wellbore. Cementing adds proper support for the casing and serves as a hydraulic seal. This hydraulic seal is particularly important in achieving zonal isolation and preventing fluid migration from various zones into groundwater resources.

Traditionally, acoustic logging of downhole conditions, for example, a cement-bond or leak associated with a signal or noise source, utilized only a monopole receiver which does not provide a radial and azimuthal position information. To accurately locate a leak or perform cement-bond logging requires additional information not provided by the use of only a monopole receiver. Efficient and accurate azimuthal information not provided using traditional systems and methods would provide the additional information required to locate and log a leak or enable cement-bond logging. Additionally, traditional efforts for azimuthal cement-bond logging use either centered ultrasonic tools or pad-based ultrasonic tools which need complicated mechanical support on the transceiver rotation or pad-structure. Further, the very high operation frequency of these ultrasonic tools leads to limited application range of the ultrasonic tools. For example, ultrasonic tools cannot be utilized in through-tubing cement-bond evaluation. A downhole tool that provides accurate location or logging information for signals associated with a leak or cement-bond logging, even for low frequency signals, is needed so that the integrity of a cement-bond or identification of leak can more accurately be determined to provide an efficient, effective and safe wellbore environment, for example, for one or more hydrocarbon operations.

BRIEF DESCRIPTION OF THE DRAWINGS

These drawings illustrate certain aspects of some of the embodiments of the present disclosure and should not be used to limit or define the claims.

Figure 1A:
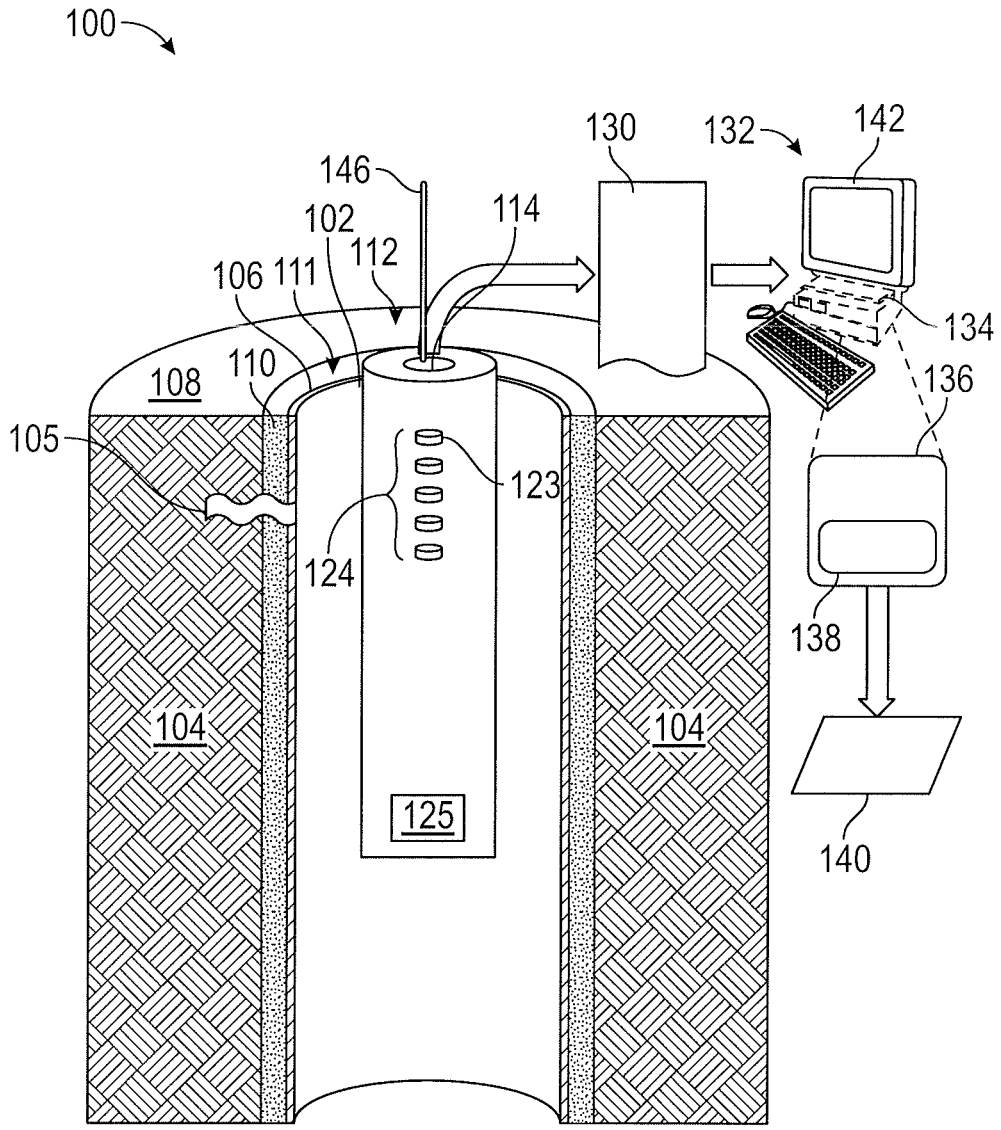
FIG. 1A depicts a partial cross-section view of an example azimuthal scanning downhole tool environment as part of a logging operation, in accordance with one or more aspects of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure generally relates to any one or more of receiving, logging, and analyzing one or more source signals for accurate cement-bond logging or location determination of the one or more source signals.

Cement-bond logging (CBL) is a procedure in the assessment of a well that ensures integrity of a cement-bond, reduces wellbore collapse risks and verifies zonal isolation. Although various types of logging may be performed for cement-bonding analysis, sonic logging performed in a wireline or logging while drilling (LWD) operation is typically used. Sonic logging generates acoustic waves that travel from a transmitter to the wellbore and that return back to one or more receivers to obtain information in the form of acoustic wave data. Various properties of the returning waves, such as interval transit time, amplitude and phase may be assessed to obtain information about the wellbore including, but not limited to, leaks or integrity of a cement-bond.

A leak may form in a cement-bond of casing, between any layers of a multi-layer casing, in a production tubing, any other downhole component and any combination thereof. A leak may comprise any type of fluid, including, but not limited to, a liquid (for example, production fluid such as any hydrocarbon), a drilling fluid (for example, mud), water, gas, any other fluid, and any combination thereof. Movement of the fluid generates what can be referred to as a signal, noise or wave (collectively referred to herein as a "signal"). The location of the movement of the fluid may be referred to herein as signal source or noise source.

Conventional or traditional noise logging tools mainly measure location in depth and may also identify radial location of a signal or noise source. Such logging provides information on the location of a leak, for example, the identification of the layer of casing or tubing of the leak. Traditionally, monopole sensors are utilized for measuring the signals or noise but such sensors are non-directional sensors and thus cannot provide azimuthal position of the signal source. Some tools may use four pressure sensors arranged 90 degrees azimuthally at the same depth. The phase shift and amplitude reduction seen by the sensor furthest from the signal (or leak) source will result in the largest differential signal from the opposite sensor. This differential signal between two pairs of opposite sensors are then used to calculate the azimuthal direction of the leak. However, such design may not be accurate and may increase expenses including time and costs of an operation. Thus, traditional methods fail to provide an accurate, efficient, and effective azimuthal resolution or direction of a signal source.

However, a downhole logging tool that employs a single receiver, a plurality of receivers, an array of receivers or any combination thereof to receive or listen for fluid flow through a casing, a tubing or both as discussed herein can be utilized to provide azimuthal information associated with a leak or integrity of a cement-bond. Such information from the downhole tool discussed herein provides accurate identification or location of a leak or cement-bond. Repair procedures of the leak or cement-bond may be carried out based, at least in part, on one or more characteristics of the leak or cement-bond, for example, depth, flow rate and length of the leak or cement-bond where the characteristics are based, at least in part, on one or more measurements by any one or more sensors and processing of such measurements. According to one or more embodiments of the present disclosure, accurate detection and location determination of a leak or flaw in the integrity of a cement-bond allows for efficient and economical repairing of a leak or failure in a cement-bond is provided as well as a solution for logging-while-drilling azimuthal cement-bond logging (CBL) and through-tubing cement evaluation without any mechanical support on rotating the transmitter/source orientation.

In one or more aspects of the present disclosure, a wellbore environment may utilize an information handling system to control one or more operations associated with the wellbore environment. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as wellbore or borehole (interchangeably used herein) construction for river crossing tunneling and other such tunneling wellbores for near surface construction purposes or wellbore u-tube pipelines used for the transportation of fluids such as hydrocarbons. Embodiments described below with respect to one implementation are not intended to be limiting.

FIG. 1A depicts a wellbore environment 100 including a downhole tool 112 for a logging operation for azimuthal scanning of the borehole 102, according to one or more embodiments. As depicted in FIG. 1A, wellbore environment 100 comprises a borehole 102 extending through various earth strata in a subterranean formation 104. The downhole tool 112 is disposed or positioned within the borehole 102. For example, the downhole tool 112 may be coupled to a conveyance component 114 for conveying the downhole tool 112 into the borehole 102. Conveyance component 114 may comprise a wireline 146. An annular casing 106 extends from the surface 108 into subterranean formation 104. Casing 106 provides a path through which one or more fluids travel from one or more downhole locations to the surface 108. Casing 106 may comprise one or more layers. In one or more embodiments, a CBL may be recorded or measured for any one or more layers of casing 106. In one or more embodiments, during cementing, the borehole 102 may be empty or filled with a fluid, such as a drilling fluid or uncured cement. The casing 106 may be attached or coupled to a wall of the borehole 102 via cement 110 pumped down from the surface 108 between the casing 106 and the wall of the borehole 102. In one or more regions of the borehole 102, the cement 110 may not be fully adhered to the casing 106. In one or more regions of the borehole 102, the casing 106 may be completely free of cement 110 depending on the location and time that the cement 110 has had to travel up the annulus 111 between the casing 106 and the borehole 102.

In one or more embodiments, downhole tool 112 comprises one or more receivers or sensors 123. A receiver array 124 may comprise a plurality of receivers 123. For example, in one or more embodiments any one or more receivers 123 may comprise a hydrophone, a pressure, an acoustic sensor or any combination thereof. In one or more embodiments, any one or more receivers 123 may be made with one or more materials including, but not limited to, piezoelectric, resistive, capacitive or optical materials. The one or more receivers 123 or the receiver array 124 may be employed by the downhole tool 112 to listen to or monitor fluid flow through a casing 106 or similarly a tubing. The fluid flow may generate one or more signals, for example, as a source or noise signal 105. Any one or more signals received by the one or more receivers 123 or the receiver array 124 are processed to identify a location of a signal or noise source 105 which is indicative of or associated with, for example, a leak. In one or more embodiments, the signal or noise source 105 may be a low-frequency signal or a high-frequency signal. One or more repair procedures can be carried out according to one or more features or one or more characteristics of the signal or noise source 105, for example, depth, flow rate and length of the leak or cement-bond. Leak detection in this way helps to prevent, for example, loss of production and also damage to the surrounding environment.

Figure 1B:
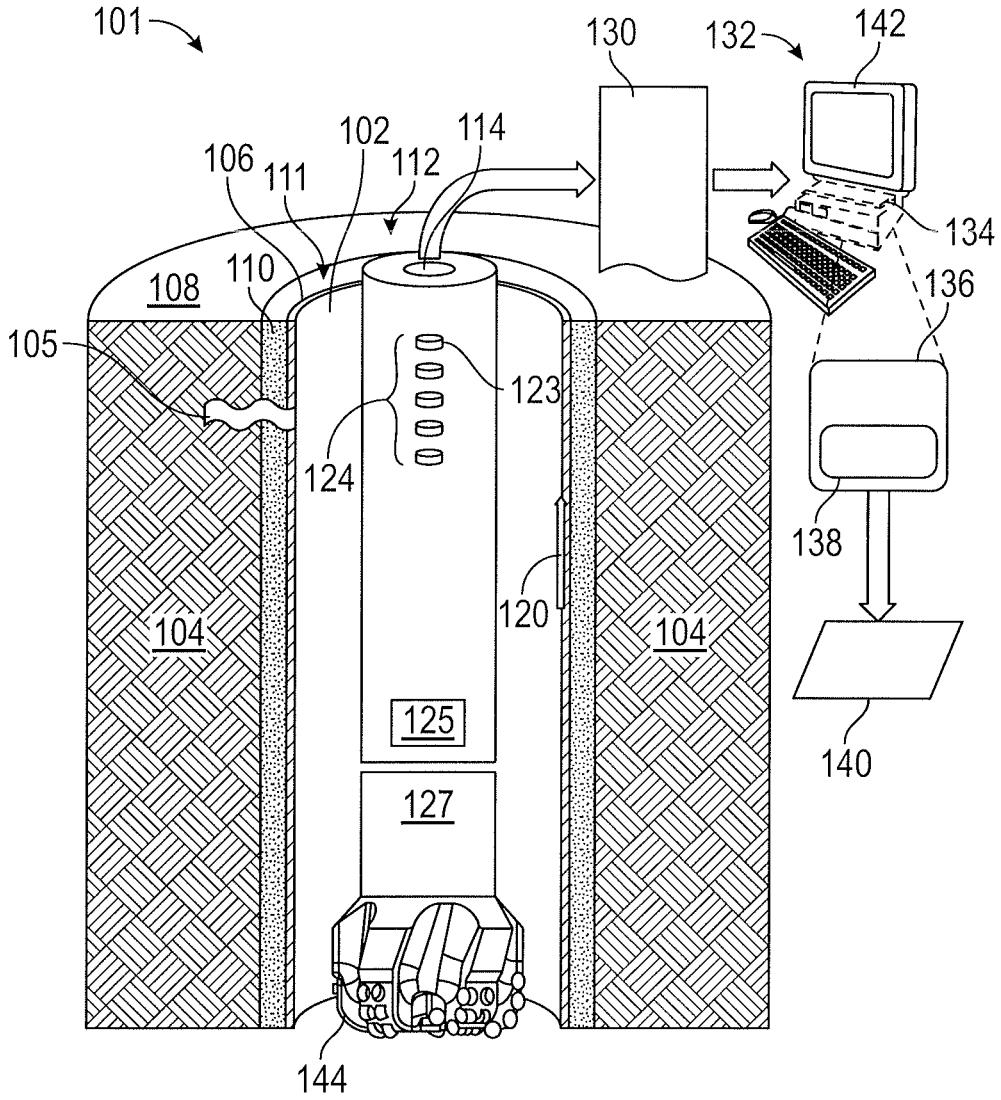
FIG. 1B depicts a partial cross-section view of an example azimuthal scanning downhole tool environment as part of a drilling operation, in accordance with one or more aspects of the present disclosure.
Figure 1C:
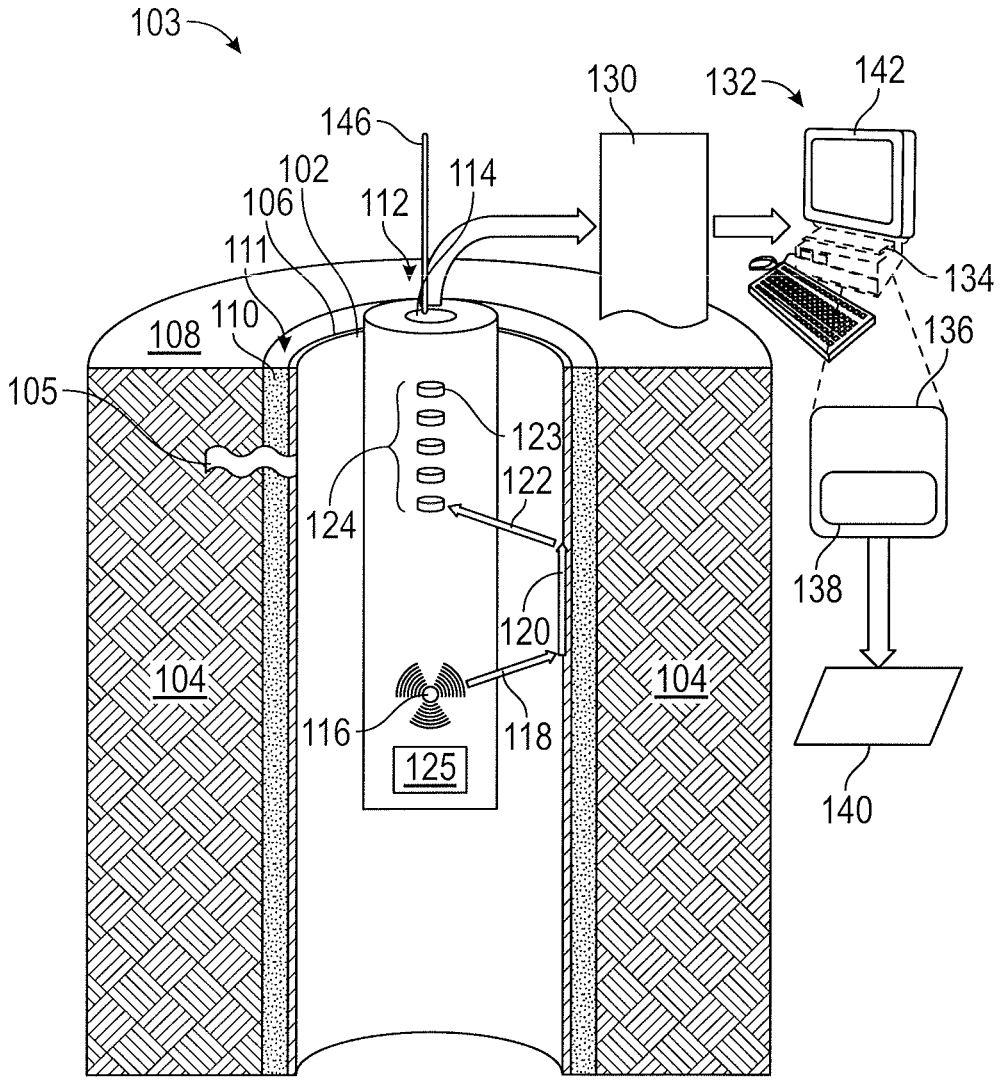
FIG. 1C depicts a partial cross-section view of an example azimuthal scanning downhole tool environment as part of a logging operation, in accordance with one or more aspects of the present disclosure.
Figure 1D:
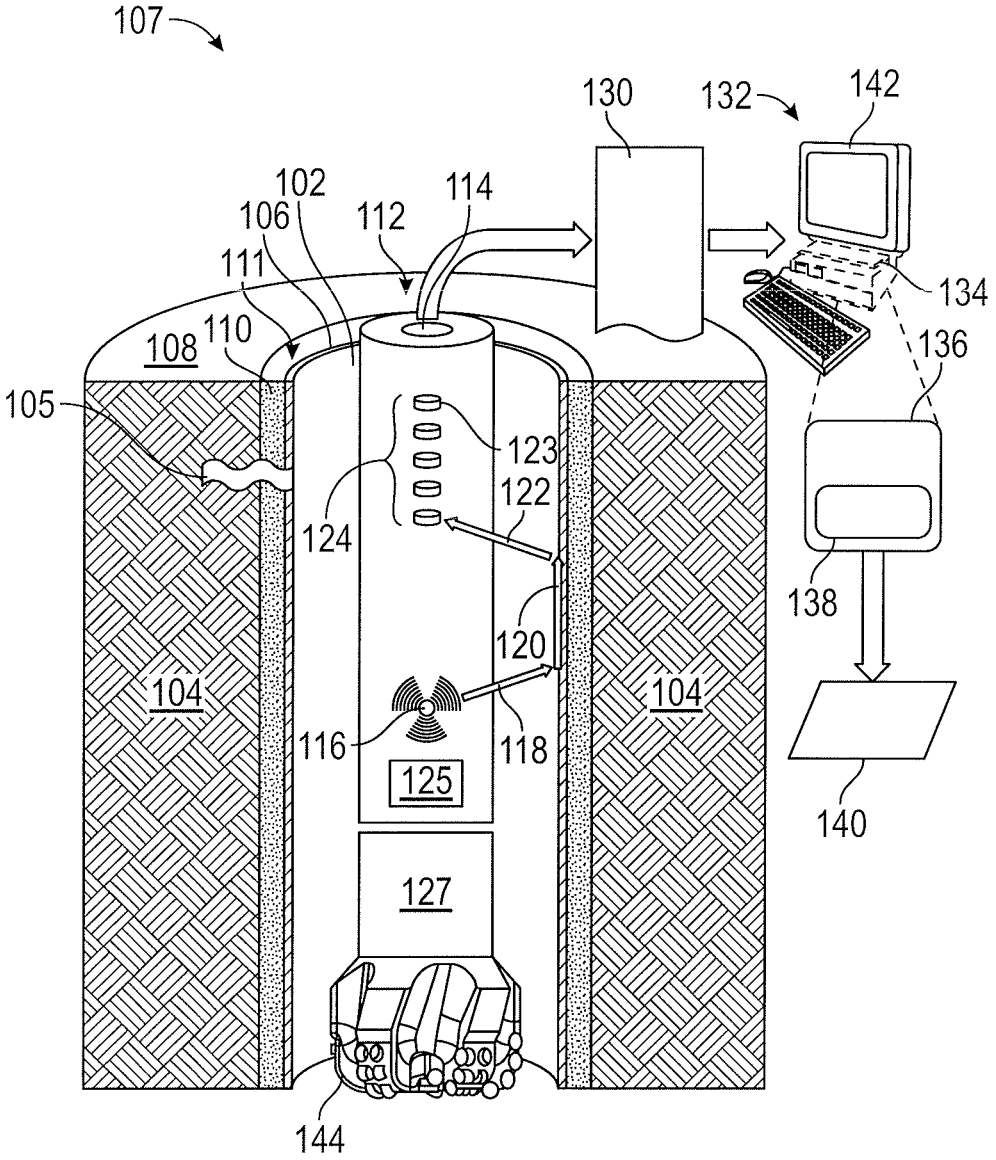
FIG. 1D depicts a partial cross-section view of an example azimuthal scanning downhole tool environment as part of a drilling operation, in accordance with one or more aspects of the present disclosure.

In one or more embodiments, the downhole tool 112 may be a logging-while-drilling (LWD) tool, a measurement-while-drilling (MWD) tool or both as illustrated in FIGS. 1B, 1D, any other sonic tool, a wireline tool as illustrated in FIGS. 1A, 1C and any other downhole tool capable of housing one or more receivers 123 or receiver array 124. The one or more receivers 123 may comprise any type of receiver, for example, a monopole receiver, a dipole receiver, a quadrupole receiver, any other multi-pole receiver, and any combination thereof. A configuration that utilizes only a single receiver 123 requires the type of receiver to be a multi-pole receiver. The one or more receivers 123 receive or measure one or more signals from a signal or noise source 105. A first configuration of receivers 123 or receiver array 124 of the downhole tool 112 may comprise one or more monopole receivers and a cross-dipole receiver. A second configuration of receivers 123 or receiver array 124 of the downhole tool 112 may comprise an independent monopole receiver, two dipole receivers of 90 degree difference in orientation and one quadrupole receiver. A third configuration of receivers 123 or receiver array 124 of the downhole tool 112 may comprise four or more azimuthal point receivers which are positioned 90 degrees apart in the same azimuth plane. A monopole signal is recorded by taking the summation of the received signal at all the azimuthal receivers, while the one or more signals of the cross-dipole are captured by taking the difference in the received signals received at the azimuthal receivers that are 180 degrees apart. The one or more signals received at the quadrupole receivers are recorded by decomposing the waveforms at receivers that are 90 degrees apart. The present invention contemplates any number of multipole receivers in combination with at least one monopole receiver.

In one or more embodiments, the downhole tool 112 comprises a memory 125 communicatively coupled to the one or more receivers 123, receiver array 124 or both. The memory 125 may store or record data received from the one or more receivers 123, receiver array 124 or both. The data may comprise one or more characteristics indicative of or associated with the one or more signals received from the signal or noise source 105. The one or more characteristics may comprise a location including but not limited to azimuthal location, radial location and depth of the signal or noise source, a flow rate associated with the signal source, length of a leak associated with the signal or noise source, integrity of a cement-bond associated with the signal or noise source, any other characteristic of the signal or noise source and any combination thereof.

In one or more embodiments, the one or more receivers 123, receiver array 124 or both may be communicatively coupled in lieu of or in addition to the memory 125 to an information handling system 132 at the surface 108. Information handling system 132 may be similar to or the same as the information handling system 500 of FIG. 5. Data 130 from the one or more receivers 123 may be communicated to the information handling system 132 via a wireline 146 as illustrated in FIGS. 1A, 1C, a telemetry system, any other communication system and any combination thereof. The data 130 may be stored in a memory 503 as discussed with respect to FIG. 5. The information handling system 132 may comprise a software application or program 134 that comprises one or more instructions executable by a processor for processing or analyzing the data 130. The software application or program 134 may comprise or be communicatively coupled to one or more modules, software applications or programs, data and any other software or systems collectively referred to as computer elements 136. Computer elements 136 may comprise processed data 138 from which one or more outputs 140 are generated. The one or more outputs 140 may be displayed on the monitor 142 of the information handling system 132. While FIG. 1A illustrates an information handling system 132 located at a surface 108, the present invention contemplates that the downhole tool 112 may comprise a computing device that executes one or more instructions of a software application or program similarly or the same as the software application or program 134.

The wave field generated by a point source received from the one or more receivers 123 or receiver array 124 may be separated based on the azimuthal order of the signals using the Bessel addition theorem, for example:

$$\Phi_d = \frac{1}{\pi} \int_{-\infty}^{+\infty} \sum_{n=0}^{+\infty} \epsilon_n \cos(n(\theta - \theta_0)) \begin{Bmatrix} I_n(fr_0)K_n(fr), & r > r_0 \\ I_n(fr)K_n(fr_0), & r < r_0 \end{Bmatrix} e^{ik(z-z0)} dk. \quad \text{Equation 1}$$

$I_n$ is the modified Bessel function of the first kind and azimuthal order number n (n=0, 1, . . . ); $\epsilon_n$ is 1 for n=0, and 2 for n>0; θ is the azimuthal measurement from the one or more receivers 123 or receiver array 124; $K_n$ is the modified Bessel function of the second kind $\Phi_d$ is emitting part of the wave displacement potential; ($r_0$, $\theta_0$, z0) represents a coordinate of the point source; (r, θ, z) is the coordinate of an arbitrary point in the wave field;

$$f = \left(k^2 - \frac{\omega^2}{\alpha_f^2}\right)^{1/2}$$

is the radial wave number, $\alpha_f$ is the acoustic velocity in fluid; k is the axial wavenumber. A monopole wave corresponds to n=0, which has no azimuthal (or θ) dependence. The azimuthal order number n controls the azimuthal. For example, a dipole wave corresponds to n=1, while a quadrupole wave corresponds to n=2. A signal or noise source 105 behind the casing 106 or in the formation 104 can excite multipole modes of signals or waves that are received, recorded or measured by the one or more receivers 123 or receiver array 124. For example, the one or more receivers 123 may comprise a monopole receiver, a cross-dipole receiver and a cross-quadrupole receiver that provide one or measurements associated with an azimuthal scan of the borehole 102.

FIG. 1B depicts a wellbore environment 101 including a downhole tool 112 for a drilling operation and azimuthal scanning of the borehole 102, according to one or more embodiments. FIG. 1B is similar to FIG. 1A except that the downhole tool 112 of FIG. 1B comprises or is coupled to a bottom hole assembly (BHA) 127. BHA 127 is coupled to a drill bit 144. Conveyance component 114 may comprise a drill string. In one or more embodiments, the downhole tool 112 may be coupled to the drill string or imbedded as a component of the drill string. The BHA 127 operates the drill bit 144 through a drill bit motor or by rotating the entire string to drill into the subterranean formation 104. In one or more embodiments, drilling mud is forced through the interior of the drill string, and through the interior of the BHA 127. The drilling mud exits from the nozzles in the drill bit 144 and cools and lubricates the bit 144 and removes cuttings and carriers the cuttings to the surface 108 along the annulus of the borehole 102. The drilling mud may also serve as a communication medium of the telemetry to the surface 108, for example, to information handling system 132. By altering the flow of the drilling mud through the interior of the drill string, pressure pulses may be generated in the form of acoustic signals in the column of drilling fluid. Moreover, by selectively varying the pressure pulses, signals can be generated to carry information indicative of downhole parameters, characteristics or conditions to the surface 108 for analysis.

FIG. 1C depicts a wellbore environment 103 including a downhole tool 112 for a logging operation for azimuthal scanning of the borehole 102, according to one or more embodiments. FIG. 1C is similar to FIG. 1A except that the downhole tool 112 of FIG. 1C comprises one or more transmitters 116. The one or more transmitters 116 transmit one or more source signals (depicted with line 118) within the borehole 102, for example, one or more acoustic signals. The one or more transmitters 116 may generate one or more source signals between 20 and 30 kilohertz (kHz), below 20 kHz, above 30 kHz, and any combination thereof. The transmitted one or more source signals 118 travel along the casing 106 as one or more casing waves (depicted with line 120) and consequently induce corresponding one or more echo responses (depicted with line 122). The one or more receivers 123 or receiver array 124 in FIG. 1C detect or monitor for the one or more echo responses 122 associated with the one or more casing waves 120 generated by the one or more source signals 118 generated by the one or more transmitters 116 as opposed to monitoring fluid flow through a casing 106 as discussed above with respect to FIGS. 1A and 1B. In one or more embodiments, any one or more of the one or more transmitters 116 may be within a single component, separate components and combinations thereof. The one or more transmitters 116 may be utilized to azimuthally scan the borehole 102 so as to determine a cement-bond condition or characteristic based, at least in part, on the one or more amplitudes determined from the one or more signals received at the one or more receivers 123, receiver array 124 or both for each transmitter azimuthal angle associated with rotation of the one or more transmitters. In one or more embodiments, the combination of a monopole source and a cross-dipole source can be realized with four azimuthal point transmitters which are positioned 90 degrees apart in the same azimuth plane. A monopole source signal is generated by firing the four point source, for example, a first transmitter 116, with the same drive-pulse, while the one or more signals of the cross-dipole are generated by firing the opposite sources, for example, a second transmitter 116 and a third transmitter 116, with the inversed-phased drive pulse. The one or more transmitters 116 may be physically or digitally rotated. Data associated with one or more echo responses may be stored or recorded in the memory 125. In one or more embodiments, the downhole tool 112 may comprise an information handling system, for example, information handling system 500 of FIG. 5. The memory 125 may be communicatively coupled to the information handling system or may be within the information handling system.

FIG. 1D depicts a wellbore environment 107 including a downhole tool 112 for a drilling operation and azimuthal scanning of the borehole 102, according to one or more embodiments. FIG. 1D is similar to FIG. 1B except that the downhole tool 112 of FIG. 1D comprises a transmitter 116 similar to or the same as FIG. 1C.

It should be recognized that while FIGS. 1A-D generally depict a land-based system, like systems may be similarly operated in subsea locations as well.

Figure 2:
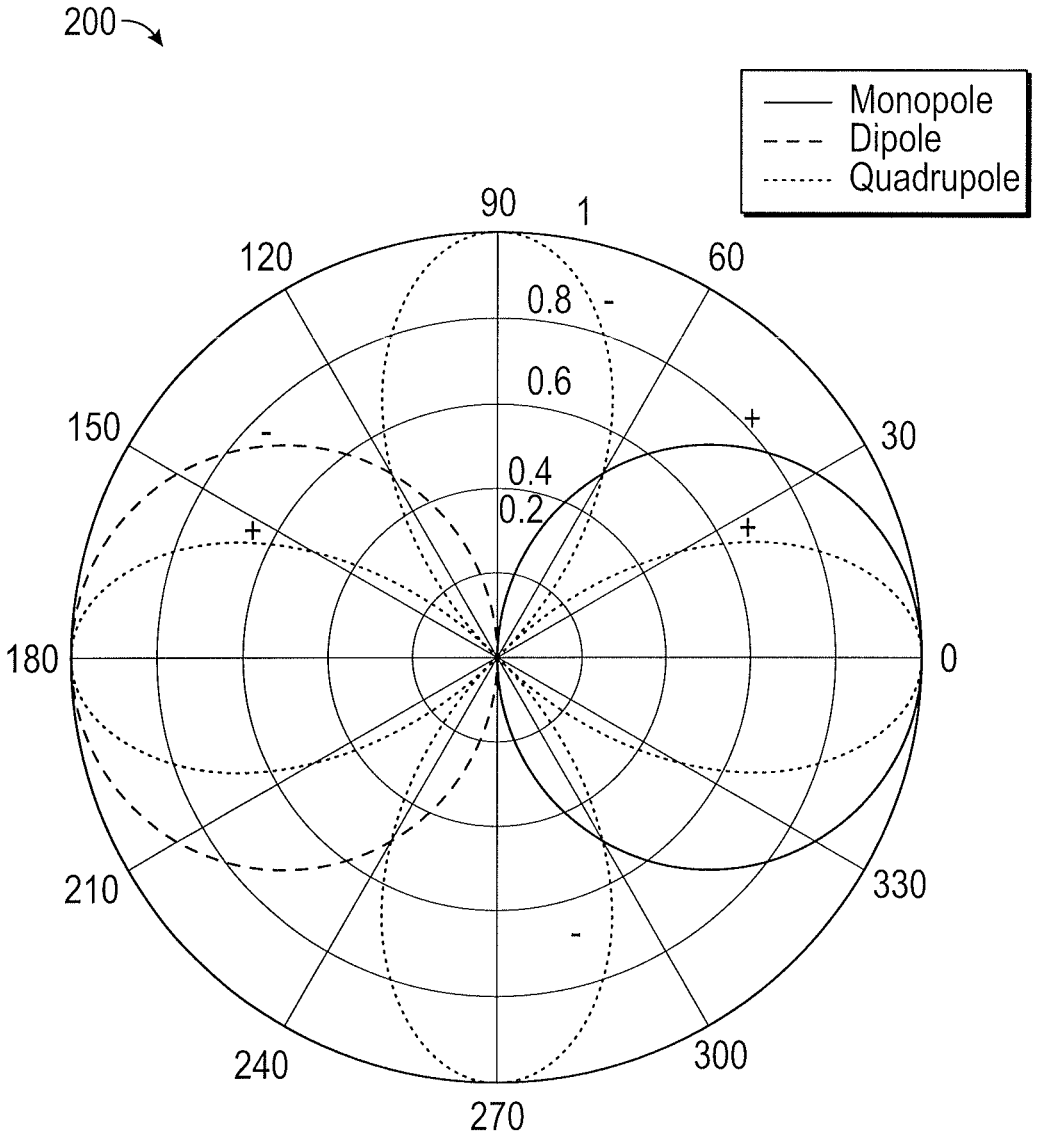
FIG. 2 depicts a received pattern from a signal source at a downhole tool, in accordance with one or more aspects of the present disclosure.

FIG. 2 illustrates a receiving pattern 200 received at a downhole tool 112 at a wellbore environment for compressional waves, for example, as discussed with respect to FIGS. 1A-D, according to one or more embodiments. The receiving pattern 200 is of a plurality of receivers 123 where the plurality of receivers 123 comprise a monopole receiver, a dipole receiver and a quadrupole receiver. A monopole receiver is omni-directional while a dipole receiver has two target directions while a quadrupole receiver has four target directions. Using only a monopole receiver does not provide the required azimuthal information for accurately determining the location or position of a signal source and using only a dipole receiver or quadrupole receiver provides a final extraction that might have a 180 degree or 90 degree uncertainty, respectively. The monopole receiver has the same amplitude at all directions while the dipole receiver has the highest positive amplitude at 0 degrees and highest negative amplitude at negative 180 degrees with the quadrupole receiver having four lobes where the maximum negative amplitude occurs at 270 degrees and 90 degrees and the maximum positive amplitude at 0 degrees and 180 degrees.

Figure 3:
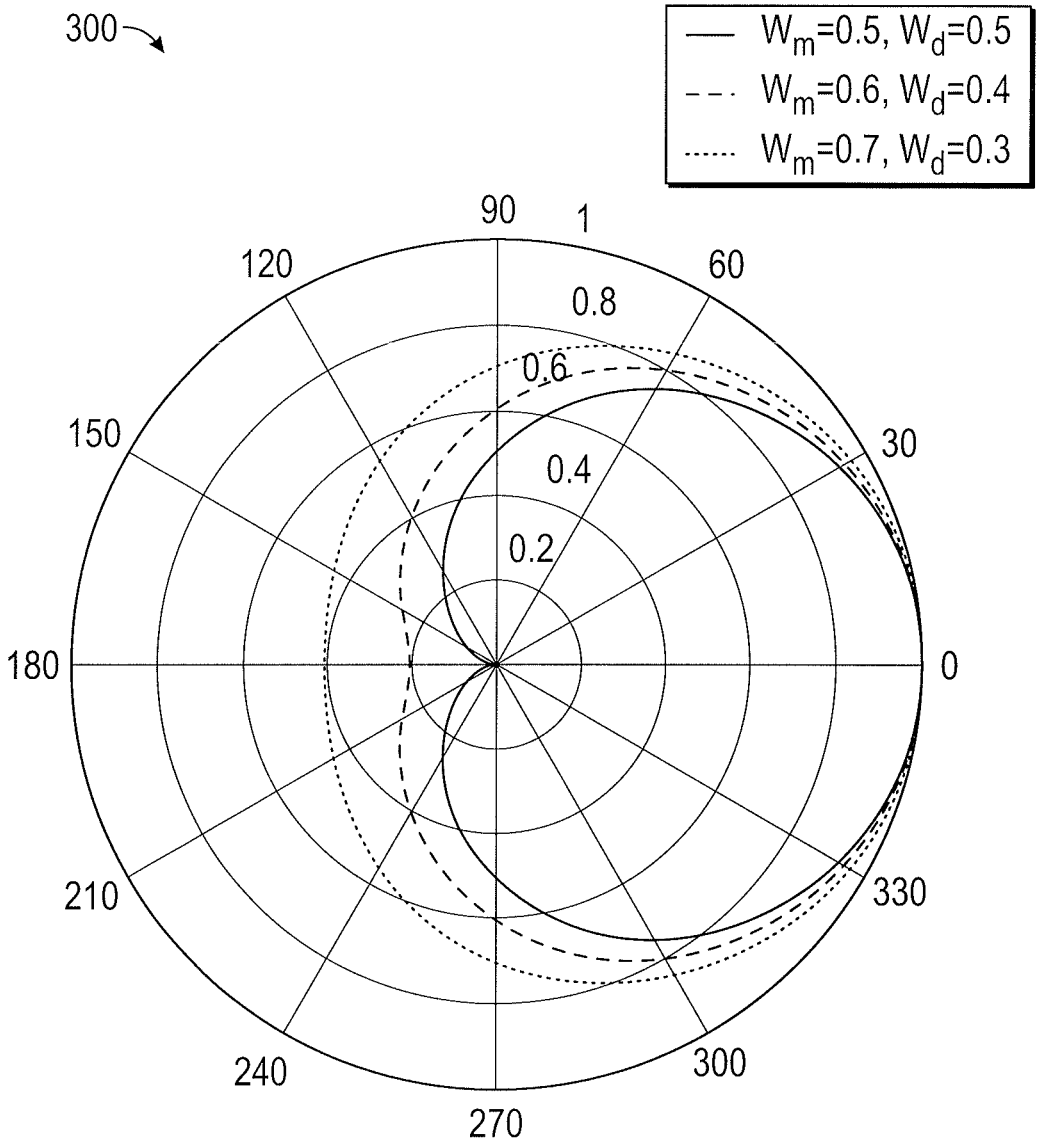
FIG. 3 depicts a received pattern from a signal source at a downhole tool with a receiver configuration, in accordance with one or more aspects of the present disclosure.

FIG. 3 depicts a received pattern 300 using a downhole tool 112 that comprises a monopole receiver and a cross-dipole receiver, where the cross-dipole receiver may comprise a first receiver and a second receiver. The configuration of receivers provides the received pattern 300 that is directionally sensitive. The cross-dipole receiver comprises the first dipole receiver 90 degrees out of phase with the second dipole receiver. FIG. 3 assumes that the phase-tuning of signals from the borehole structure has been fully removed. $W_m$ is a weight applied to the signal received at the monopole receiver and $W_d$ is a weight applied to the signal received at the dipole receiver. As shown in FIG. 3, when applying the same weights on a signal at a monopole receiver and the signals received at the cross-dipole receivers, maximum signals are observed at the target angle (0 degrees), and zero signal is observed at the 180 degrees direction of the target azimuth (180 degrees). If the signal at the monopole receiver and the signals at the cross-dipole receivers are not well-balanced, for example, the equivalent weights for the received signal at the monopole receiver and the received signals at the cross-dipole receivers is 0.7 and 0.3, respectively, the receiver pattern still shows promising results indicating that the maximum of the combined signals can be utilized to extract the target angle.

Figure 4:
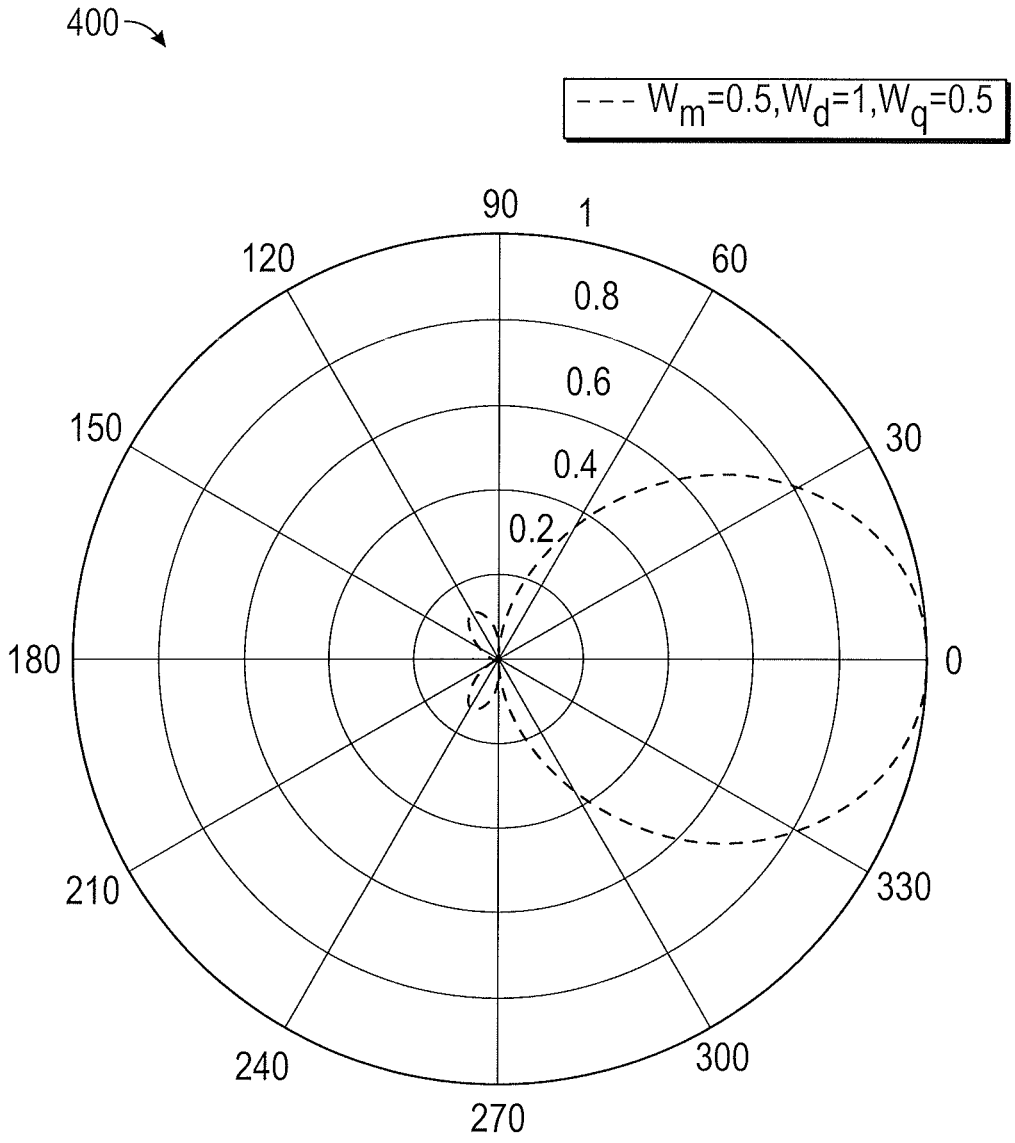
FIG. 4 depicts a received pattern from a signal source at a downhole tool with a receiver configuration, in accordance with one or more aspects of the present disclosure.

FIG. 4 depicts a received pattern 400 using a downhole tool 112 that comprises a monopole receiver, a dipole receiver (or cross-dipole receiver) and a quadrupole receiver (or cross-quadrupole receiver). Using the monopole receiver, cross-dipole receiver and cross-quadrupole receiver enhances the azimuthal resolution as illustrated in FIG. 4, where it is assumed that the phase-tuning of signals from the borehole structure has been fully removed. The received pattern 400 is the combination of a weighted ($W_m$) signal received at the monopole receiver, a weighted ($W_d$) signal received at the cross-dipole receiver and a weighted ($W_q$) received signal at the cross-quadrupole receiver. FIG. 4 illustrates an improvement with a narrower main lob over the receiver pattern 300 of FIG. 3. By using three weights, a receiving pattern is generated that is pointing the maximum amplitude at zero degrees.

Figure 5:
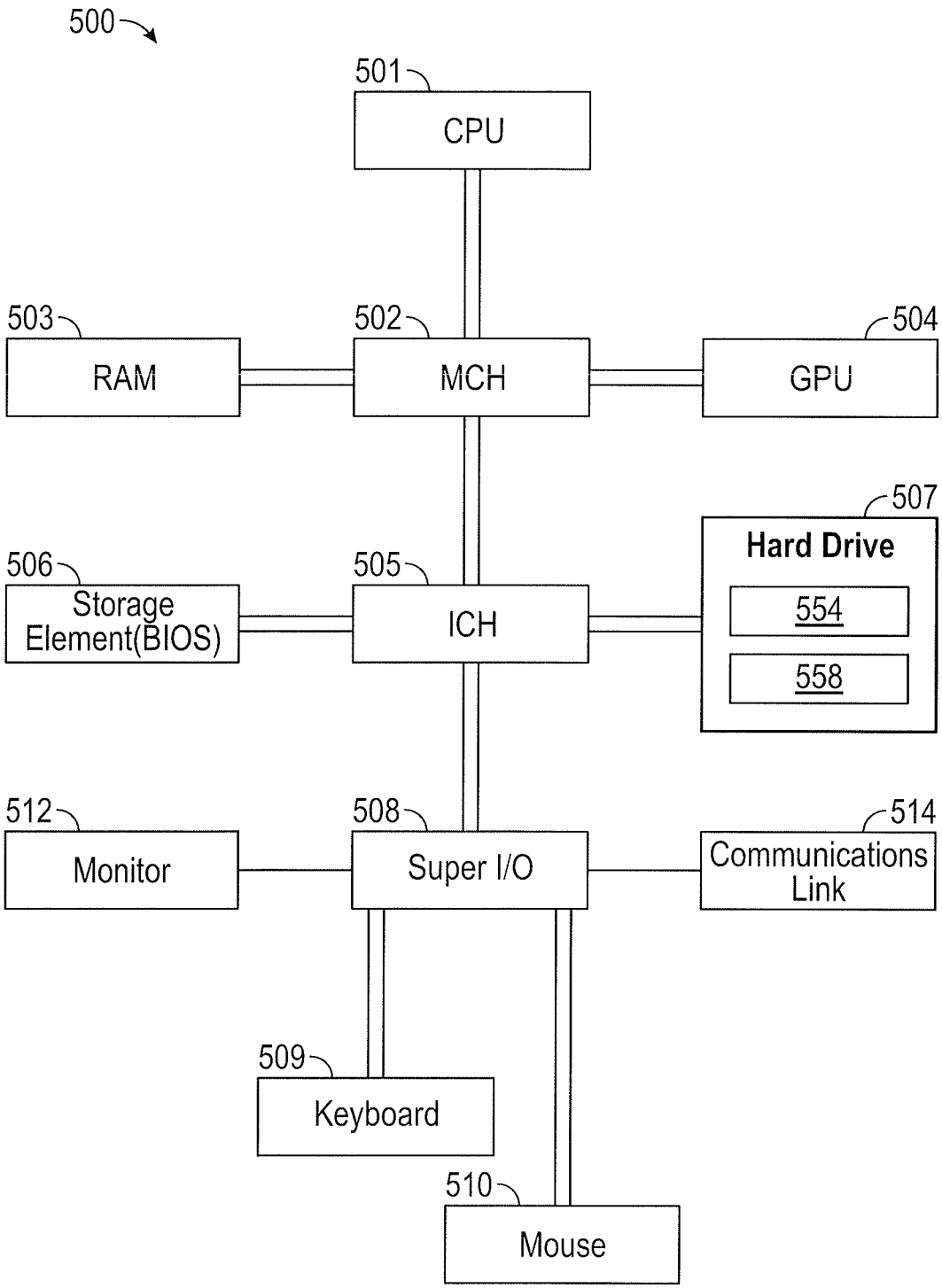
FIG. 5 is a schematic diagram of an information handling system for a wellbore environment, according to one or more aspects of the present disclosure.

FIG. 5 is a diagram illustrating an example information handling system 500, for example, for use with or by an associated wellbore environment illustrated in FIGS. 1A-D, according to one or more aspects of the present disclosure. The information handling system 132 of FIGS. 1A-D may take a form similar to the information handling system 500. A processor or central processing unit (CPU) 501 of the information handling system 500 is communicatively coupled to a memory controller hub (MCH) or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. Processor 501 may be configured to interpret and/or execute program instructions or other data retrieved and stored in any memory such as memory 503 or hard drive 507. Program instructions or other data may constitute portions of a software or application, for example, the one or more applications 558 or data 554, for carrying out one or more methods described herein. The one or more applications 558 may comprise one or more software programs or executable instructions executable by the processor 501. Memory 503 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software program or the one or more applications 558 or data 554 may be retrieved and stored in memory 503 for execution or use by processor 501. In one or more embodiments, the memory 503 or the hard drive 507 may include or comprise one or more non-transitory executable instructions that, when executed by the processor 501 cause the processor 501 to perform or initiate one or more operations or steps. The information handling system 500 may be preprogrammed or it may be programmed (and reprogrammed) by loading a program from another source (for example, from a CD-ROM, from another computer device through a data network, or in another manner).

The data 554 may include treatment data, geological data, fracture data, microseismic data, or any other appropriate data. The one or more applications 558 may include a fracture design model, a reservoir simulation tool, a fracture simulation model, or any other appropriate applications. In one or more embodiments, a memory of a computing device includes additional or different data, application, models, or other information. In one or more embodiments, the data 554 may include treatment data relating to fracture treatment plans. For example the treatment data may indicate a pumping schedule, parameters of a previous injection treatment, parameters of a future injection treatment, or one or more parameters of a proposed injection treatment. Such one or more parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 554 may include one or more signals received by one or more receivers 123 or receiver array 124 of FIGS. 1A-D, for example, data 554 may comprise processed data 138 or data 130 as discussed above with respect to FIGS. 1A-D.

The one or more applications 558 may comprise one or more software programs or applications, one or more scripts, one or more functions, one or more executables, or one or more other modules that are interpreted or executed by the processor 501. For example, the one or more applications 558 may include a fracture design module, a reservoir simulation tool, a hydraulic fracture simulation model, or any other appropriate function block. The one or more applications 558 may include machine-readable instructions for performing one or more of the operations related to any one or more embodiments of the present disclosure. The one or more applications 558 may include machine-readable instructions for generating a user interface or a plot, for example, illustrating fracture geometry (for example, length, width, spacing, orientation, etc.), pressure plot, hydrocarbon production performance. The one or more applications 558 may obtain input data, such as treatment data, geological data, fracture data, or other types of input data, from the memory 503, from another local source, or from one or more remote sources (for example, via the one or more communication links 514). The one or more applications 558 may generate output data and store the output data in the memory 503, hard drive 507, in another local medium, or in one or more remote devices (for example, by sending the output data via the one or more communication links 514).

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in some embodiments, functionality associated with components of information handling system 500 may be implemented in special purpose circuits or components. In other embodiments, functionality associated with components of information handling system 500 may be implemented in configurable general purpose circuit or components. For example, components of information handling system 500 may be implemented by configured computer program instructions.

Memory controller hub 502 may include a memory controller for directing information to or from various system memory components within the information handling system 500, such as memory 503, storage element 506, and hard drive 507. The memory controller hub 502 may be coupled to memory 503 and a graphics processing unit (GPU) 504. Memory controller hub 502 may also be coupled to an I/O controller hub (ICH) or south bridge 505. I/O controller hub 505 is coupled to storage elements of the information handling system 500, including a storage element 506, which may comprise a flash ROM that includes a basic input/output system (BIOS) of the computer system. I/O controller hub 505 is also coupled to the hard drive 507 of the information handling system 500. I/O controller hub 505 may also be coupled to an I/O chip or interface, for example, a Super I/O chip 508, which is itself coupled to several of the I/O ports of the computer system, including a keyboard 509, a mouse 510, a monitor 512 and one or more communications links 514. Any one or more input/output devices receive and transmit data in analog or digital form over one or more communication links 514 such as a serial link, a wireless link (for example, infrared, radio frequency, or others), a parallel link, or another type of link. The one or more communication links 514 may comprise any type of communication channel, connector, data communication network, or other link. For example, the one or more communication links 514 may comprise a wireless or a wired network, a Local Area Network (LAN), a Wide Area Network (WAN), a private network, a public network (such as the Internet), a wireless fidelity (WiFi) network, a network that includes a satellite link, or another type of data communication network.

Figure 9:
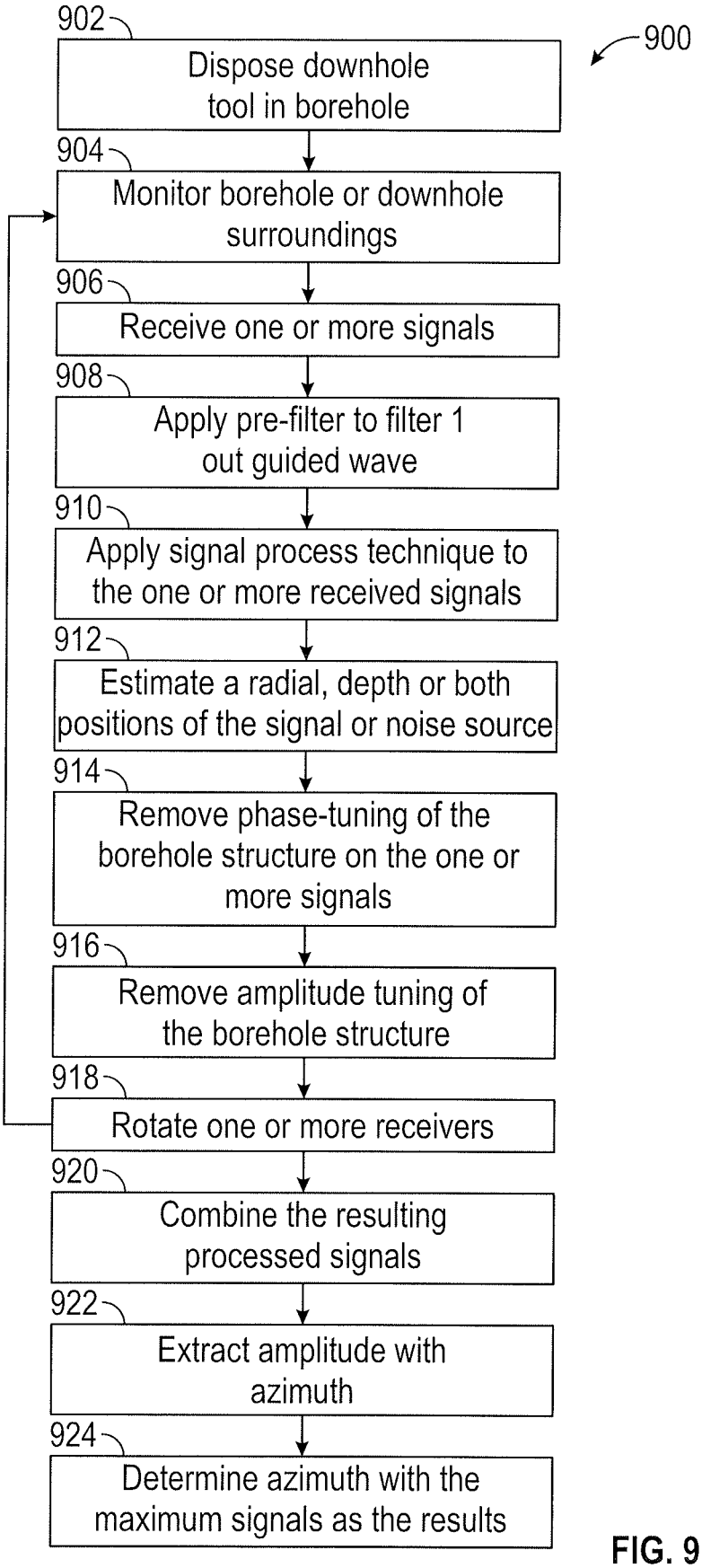
FIG. 9 is a flowchart of operations for processing signals received at a plurality of downhole receivers to locate the three-dimensional position of a signal source, according to one or more aspects of the present disclosure.

FIG. 9 depicts a flowchart 900 of operations for processing signals received at a plurality of downhole receivers, for example, one or more receivers 123 or receiver array 124, to locate the three-dimensional position of a signal or noise source, for example signal or noise source 105, according to one or more aspects of the present disclosure for leak detection associated with a cement-bond. The steps of FIG. 9 illustrate, according to one or more embodiments, a workflow for extraction of the azimuth position of a signal or noise source from a multipole measurement. The azimuthal direction of the source is located by the maximum value of a plurality of receivers that comprise at least one or more monopole receivers and at least one of one or more dipole receivers, one or more quadrupole receivers and any combination thereof. The radial distance of the signal or noise source 105 from the borehole center is computed from beamforming algorithm using data from the one or more receivers 123, the receiver array 124 or both. The azimuth of the signal or noise source is extracted by the maximum amplitude of the combined signals of the plurality of receivers in the azimuthal direction.

At step 902, a downhole tool, for example, downhole tool 112 of any of FIGS. 1A-D, disposed in a borehole 102 at a depth for a signal or noise source operation. The downhole tool 112 may be disposed or positioned at one or more depths along the borehole 102 with the receivers 123 or receiver array 124 obtaining data, measurements or information at any one or more depths. At step 904, a plurality of receivers as discussed with respect to FIGS. 1A-D, for example, receiver array 123 or two or more receivers 123, monitor for or wait to receive one or more signals such as signal 107 from within the borehole 102 such as from formation 104, casing 106, cement 110, any other downhole structure or component and any combination thereof. The plurality of receivers comprise a monopole receiver and at least one multipole receiver, for example, one or more dipole receiver, one or more quadrupole receiver, and any combination thereof. In one or more embodiments, the plurality of receivers may monitor the borehole 102 or downhole surroundings on a continuous basis, based on a timer or semaphore, based on a command or signal, for example, a command or signal from information handling system 132, any other basis and any combination thereof.

At step 906, any one or more of the plurality of receivers receive one or more signals as one or more measurements, for example, one or more signals 107, indicative of one or more characteristics of a leak or integrity of a cement-bond from a signal or noise source 105. The one or more received signals may be stored or recorded in a memory of the downhole tool or at the surface as discussed with respect to FIGS. 1A-D. For example, the one or more characteristics may comprise an amplitude of the one or more received signals. In one or more embodiments, the plurality of receivers comprises one or more monopole receivers and one or more multipole receivers. The monopole receiver may receive the one or more signals associated with a signal or noise source 105 as one or more monopole measurements and the one or more multipole receivers may receive the one or more signals associated with the signal or noise source 105 as one or more multipole measurements. The one or more measurements or data received by the plurality of receivers may be stored or recorded in a memory of the downhole tool, transmitted to another downhole tool or component, transmitted to the surface, for example, to information handling system 132, and any combination thereof.

In one or more embodiments, an amplitude of a signal 107 may be received by at least a first receiver of the plurality of receivers and at least a second receiver of the plurality of receivers where the first receiver comprises one or more monopole receivers and the second receiver comprises at least one of one or more dipole receivers (or cross-dipole receivers), one or more quadrupole (or cross-quadrupole) receivers, any other one or more multipole receivers, and any combination thereof. For configurations where a single first receiver, a single second receiver or both is implemented, a physical instrument may be required to rotate the receivers to obtain the necessary measurements. In one or more embodiments, one or more of the plurality of receivers may be rotated physically or digitally. The present invention contemplates that any number of monopole receivers, dipole receivers (including but not limited to cross-dipole receivers), quadrupole receivers (including but not limited to cross-quadrupole receivers), any other multipole receivers and any combination thereof may be utilized.

At step 908, one or more pre-filters are applied to the one or more measurements of the plurality of receivers to remove one or more guided waves present within the borehole. For example, one or more guided waves may propagate along the casing 106 of the borehole 102 of FIGS. 1A-D. A pre-filter may be applied to filter out or diminish the interference of a guided wave in the borehole. In one or more embodiments, a pre-filter may not be required or applied. In one or more embodiments, a pre-filter is applied to one or more of the one or more monopole measurements and the one or more multipole measurements.

At step 910, one or more signal processing techniques are applied to the one or more measurements of the plurality of receivers to obtain one or more processed measurements. In one or more embodiments, the one or more signal processing techniques are applied to the resulting one or more measurements after application of the pre-filter in step 908. For example, one or more spatial techniques may be applied to any one or more of the one or more measurements such as beamforming.

At step 912, an estimated radial, depth or both positions of the signal or noise source are determined based, at least in part, on the processed one or more measurements as discussed in step 910. For example, a receiver array such as receiver array 124 or a plurality of receivers 123 is used to obtain the necessary one or more measurements or data to obtain the radial positioning of the signal or noise source.

At step 914, phase-tuning of the borehole structure on the one or more received signals may be removed. For example, the phase-tuning is utilized to remove the amplitude and phase change associated with the borehole structure from the one or more resulting signals from step 912. As part of step 914, a determination of the effect of the borehole structure may be modelled, for example, a numerical model, such as a finite element model, may be utilized. The modelling may be based, at least in part, on an inner radius of one or more layers of the casing, an outer radius of one or more layers of the casing, an acoustic property of the one or more layers of the casing, any other property of one or more layers of the casing, and any combination thereof. The modelling will estimate the phase, arrival time or both of the signals as the signal is transmitted or propagates through the layered borehole structure, where phase is used in the frequency domain and arrival time is used in the time domain. The difference between the phase of the signal from the modelling of the borehole structure and the phase of the one or more resulting signals from step 912 is determined. The modelling will also estimate the amplitude of the signal as it is transmitted or propagates through the layered borehole structure instead of a homogeneous fluid.

At step 916, amplitude-tuning of the borehole structure on the one or more received signals may be removed. The difference between the amplitude of the signal from the modelling of the borehole structure and the amplitude of the one or more resulting signals from step 912 is determined. In one or more embodiments, step 916 may not be utilized and the process continues at step 918.

At step 918, one or more receivers of the plurality of receivers may be rotated to obtain 360 degrees of coverage of the borehole. For example, the sensor array 124 or one or more receivers 123 may be physically or digitally rotated to obtain 360 degrees of coverage of the borehole at a depth of the downhole tool. The process continues at step 904 until no more rotation is required or the desired coverage has been obtained. In one or more embodiments, the total number of the plurality of receivers may be such that no rotation is required to obtain the necessary or desired. Once data, information or measurements have been acquired to perform a determination as to the location of the signal or noise source, the process continues at step 920.

Figure 6:
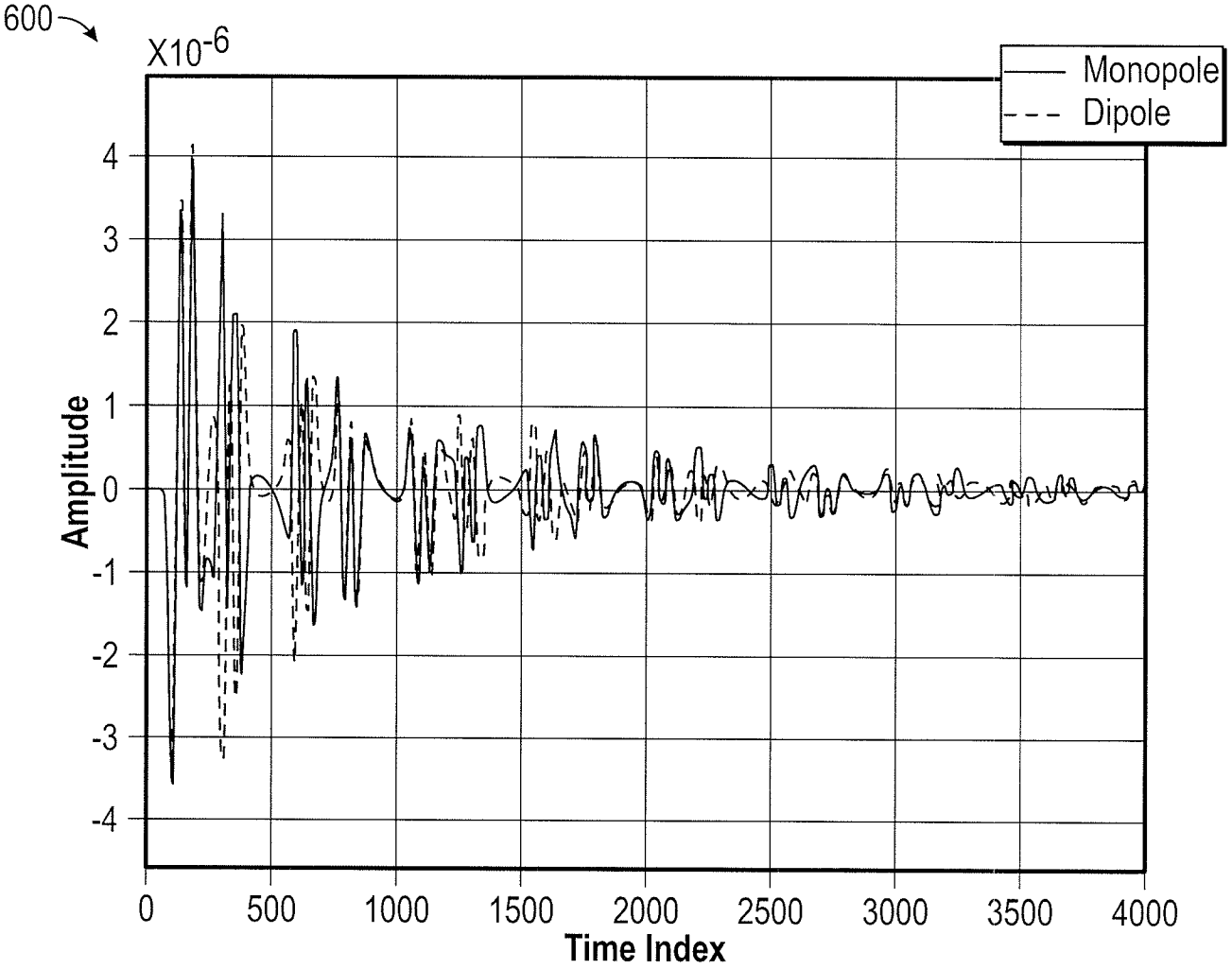
FIG. 6 is a graph illustrating monopole and dipole wave signals, according to one or more aspects of the present disclosure.
Figure 7:
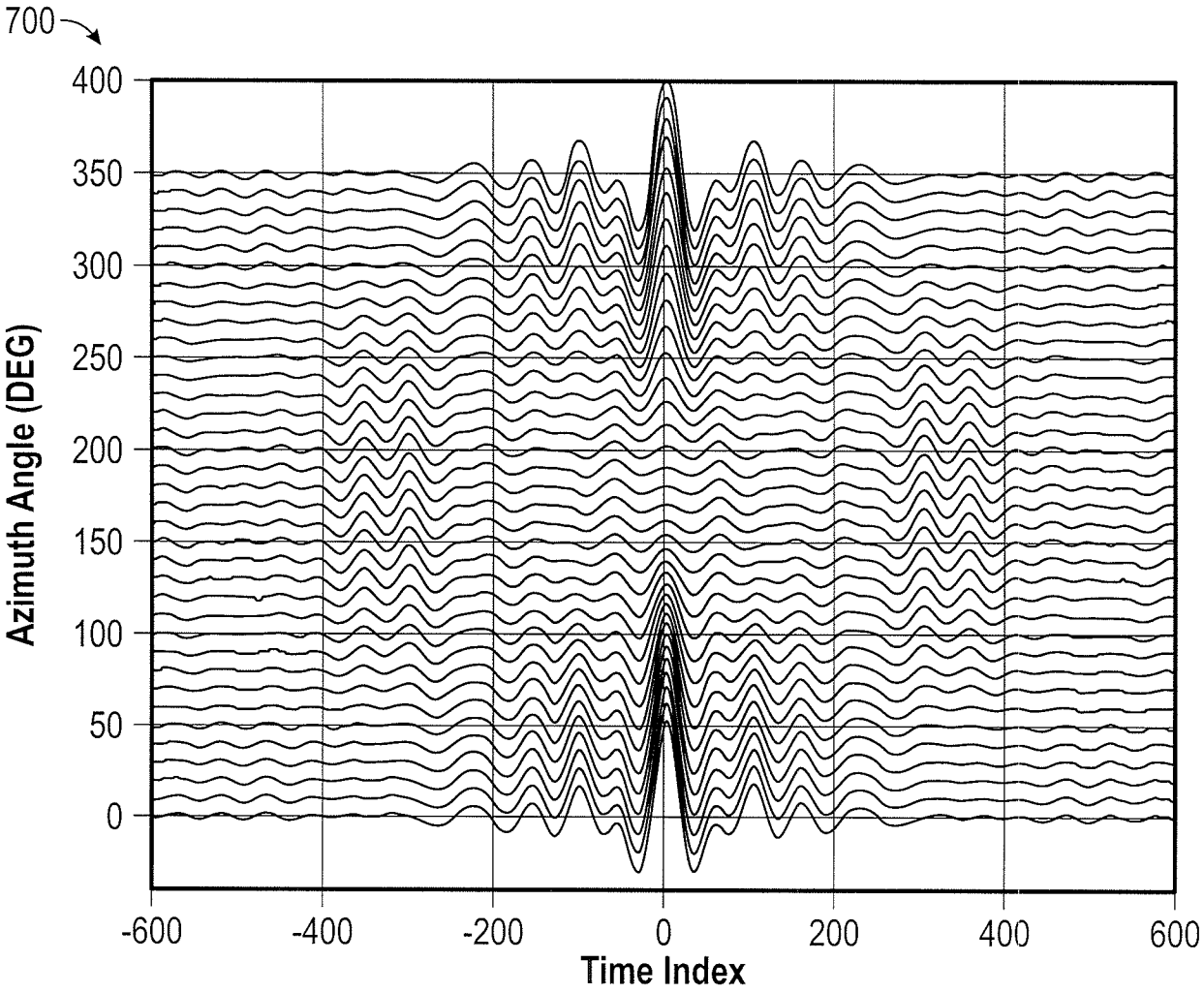
FIG. 7 is a graph illustrating combined waveforms at different azimuthal angles after removing the phase-tuning by the borehole structure, according to one or more aspects of the present disclosure.

At step 920, the resulting one or more signals after processing or the one or more processed measurements according to any one or more of the above steps are combined to obtain or provide one or more receiving patterns, for example, as illustrated in FIG. 3 and FIG. 4. At step 922, the amplitude of the one or more receiving patterns with azimuth is extracted. For example, as illustrated in FIG. 6 at 600, a received signal (first signal) at a monopole receiver and a received signal (second signal) at a dipole receiver associated with a signal or noise source behind a casing at zero degrees are captured, stored or recorded separately to generate a wave field such that amplitude of each of the received signals is associated with a time index. The phase-tuning effects on the first and second signals are removed and the dipole receiver is rotated, physically or digitally, so as to obtain the required one or more signals at an associated time index until 360 degrees azimuthal coverage of the borehole structure has been obtained as illustrated in FIG. 7 at 700. FIG. 7 illustrates a plurality of waveforms associated with a depth with each of the waveforms corresponding to a different azimuthal angle of the receiver. A first dipole receiver is rotated to a different receiver azimuthal angle and the one or more signals (or one or more waveforms) received at the first dipole are recorded with the second dipole receiver located 90 degrees apart from the first dipole receiver. The one or more signals (or one or more waveforms) received at the single monopole is recorded where no rotation is needed due to the isotropic nature of the monopole receiver. The one or more waveforms are summed with equal weights at each respective receiver azimuthal angle to produce the waveforms in FIG. 7.

Figure 8:
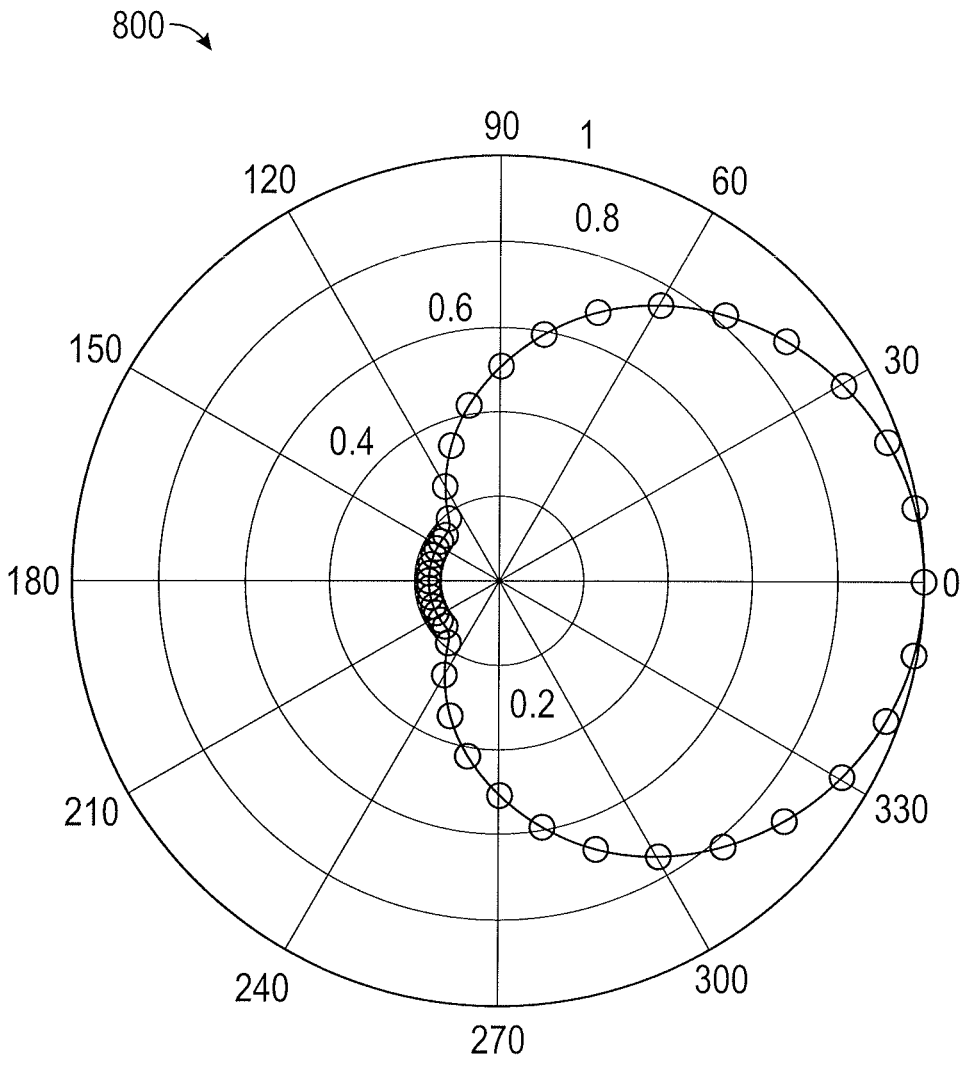
FIG. 8 is a plot illustrating extracted amplitude from the waveforms in FIG. 7 in which the azimuth of the signal or noise source is estimated by the maximum of the amplitude curve, according to one or more aspects of the present disclosure.

At step 924, the azimuth associated with the maximum received signals of the one or more processed measurements is determined at each downhole tool depth. The amplitude of each of the waveforms versus azimuth (illustrated in FIG. 7) is extracted as illustrated in FIG. 8 at 800 in which the azimuth of the source (source azimuth) is estimated by the maximum of the amplitude curve. As shown in FIG. 8, the amplitude extractions agree with the theoretical receiving pattern of a combination of a monopole receiver and a dipole receiver illustrated in FIG. 3. The azimuth of the source or noise signal is estimated at the maximum of the curve. In one or more embodiments, the combination of a monopole receiver and a cross-dipole receiver can be realized with four azimuthal point receivers, which are positioned 90 degrees apart in the same azimuth plane. A monopole receiver signal is obtained by summing the one or more signals received at the four monopole receivers while the signals of the cross-dipole receiver are obtained by subtracting the signals of the opposite receivers. Similarly, the combination of a monopole receiver, a cross-dipole receiver and a quadrupole receiver can be realized with eight point receivers positioned 45 degrees apart in the same azimuth plane. A monopole receiver signal is obtained by summing the signals of eight monopole receivers, the signals of the cross-dipole are obtained by subtracting the signals of the opposite receivers, and the signals of quadrupole receivers are obtained by summing the signals of one pair of opposite receivers and subtracting the signals of the other pair of opposite receivers. The radial ticks 0.2, 0.4, 0.6, 0.8 represent the amplitude of the waveform at each receiver azimuthal angle. The maximum amplitude of the curve occurs at 0 degrees and the value is unity.

At step 926, the location of the signal or noise source is identified or determined based, at least in part, on the receiver azimuthal angle of step 924 and the radial position and depth position of step 912. In one or more embodiments, the location of the signal or noise source may be output to a display, for example, display 142 of information handling system 132.

In one or more embodiments, any one or more steps of FIG. 9 may be omitted or repeated and may be performed in a different order. In one or more embodiments, any one or more of steps 904-926 may be performed downhole, for example, by one or more components of the downhole tool, one or more other downhole tools, one or more other downhole components and any combination thereof. In one or more embodiments, data, one or more measurements, and information obtained from the plurality of receivers may be stored downhole, for example, in memory 125 of the downhole tool 112, with processing of the data, one or more measurements and information performed at the surface 108, for example, by information handling system 132.

Figure 10:
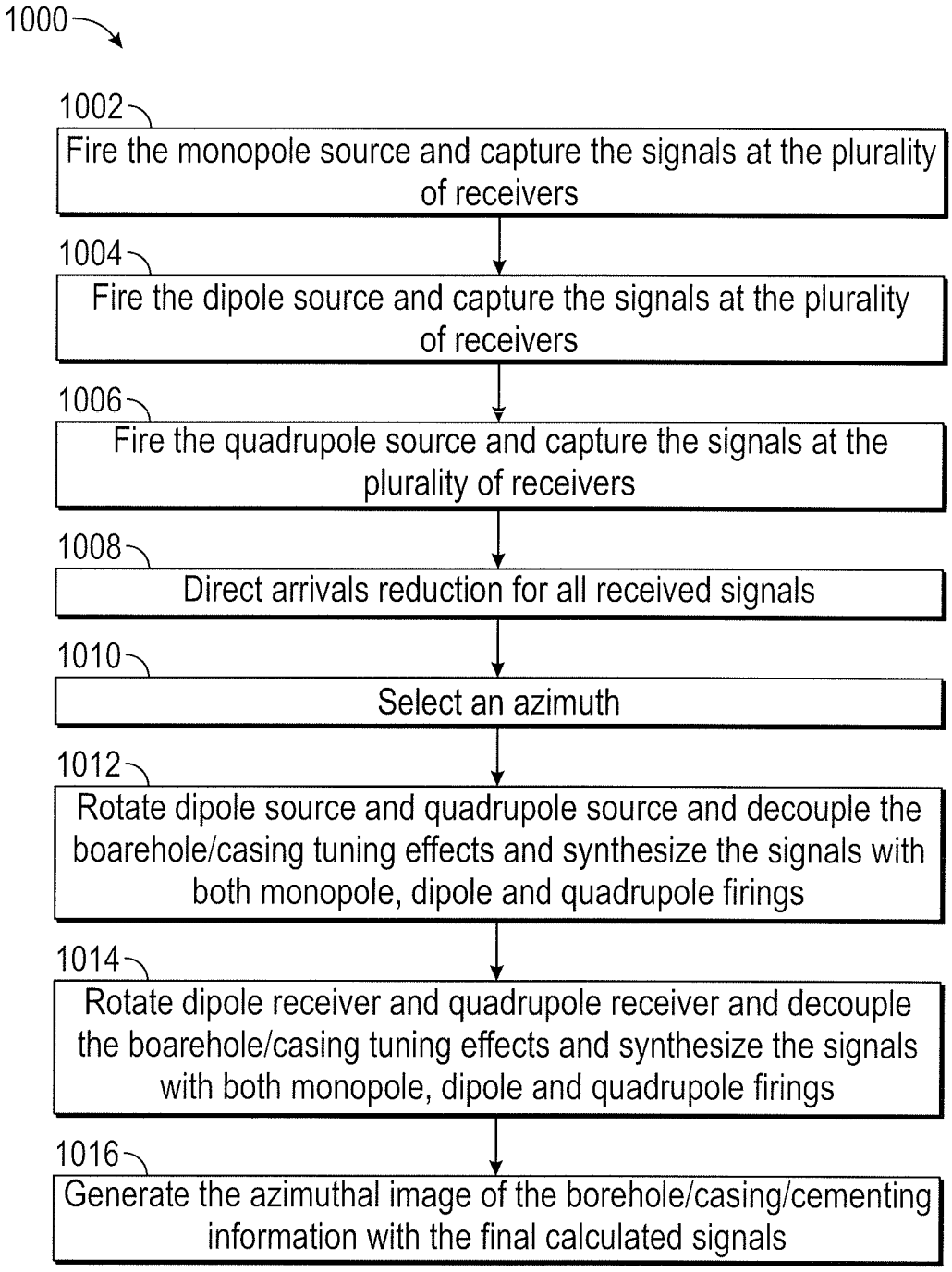
FIG. 10 is a flowchart of operations for processing signals generated by a source and received at a plurality of downhole receivers to locate the three-dimensional position of a signal source, according to one or more aspects of the present disclosure.

FIG. 10 depicts a flowchart 1000 of operations for processing signals, for example, one or more echo responses 122, generated by a source, for example, one or more transmitters 116 of a downhole tool 112 and received at a plurality of receivers, for example one or more receivers 123 or receiver array 124 of the downhole tool 112, for evaluation of one or more characteristics of a cement-bond of casing 106 in the borehole 102.

At step 1002, a first shot of at least a first transmitter 116 is generated or fired with one or more resulting signals from the first shot captured or received at a plurality of receivers 123, receiver array 124 or both. For example, the source generates a signal in the casing that is captured or received by the plurality of receivers 123 or receiver array 124 as the one or more resulting signals. The one or more resulting signals or one or more amplitudes of the one or more resulting signals relate or correspond to a bond condition (a cement-bond condition or characteristic) of the cement (for example, cement 110 of FIGS. 1A-1D) behind the casing (for example, casing 106 of FIGS. 1A-1D). For example, a first transmitter 116 may comprise a monopole source. The monopole source may be fired such that a first one or more signals, for example, a first one or more source signals 118, are generated that generate a first one or more casing waves 120 and subsequently received or captured, for example, as a first one or more echo responses 122, by a monopole receiver, a dipole receiver and a quadrupole receiver. In one or more embodiments, one or more monopole receivers and one or more of one or more dipole (or cross-dipole) receivers, one or more quadrupole (or cross-quadrupole) receivers, any other one or more multi-pole (or cross-multipole) receivers and any combination thereof may be utilized to receive the first one or more signals from the monopole source.

At step 1004, a second shot of at least a second transmitter 116 is generated or fired with one or more resulting signals of the second shot captured or received at the plurality of receivers 123 or receiver array 124. For example, a second transmitter 116 may comprise a cross-dipole source. The cross-dipole source may be fired such that a second one or more signals, for example, a second one or more source signals 118 that generate a second one or more casing waves 120, are generated and subsequently received or captured, for example, as a second one or more echo responses 122, by the monopole receiver, the dipole receiver and the quadrupole receiver. In one or more embodiments, one or more monopole receivers and one or more of one or more dipole (or cross-dipole) receivers, one or more quadrupole (or cross-quadrupole) receivers, any other one or more multi-pole (or cross-multipole) receivers and any combination thereof may be utilized to receive the second one or more signals from the dipole source. In one or more embodiments, the transmitter 116 may comprise one or more independent transmitters or one or more sub-transmitters located at the same depth or disposed or positioned at the same axial location of the downhole tool but at a different azimuths or azimuthal angles from each other. In one or more embodiments, one or more sub-transmitters may be fired in different combinations to achieve the effect of, for example, a monopole transmitter, a dipole transmitter, a quadrupole transmitter and any combination thereof. For example, a transmitter may comprise four monopole transmitters positioned 90 degrees apart at the same depth. A monopole transmitter can be achieved by firing all four sub-transmitters simultaneously. A dipole transmitter can be achieved by firing a pair of opposite-facing transmitter simultaneously but in opposite phase. A quadrupole transmitter can be achieved by firing a first set of opposite transmitters simultaneously, while firing the other orthogonal second set of opposite transmitters simultaneously in opposite phase from the first set.

At step 1006, a third shot of at least a third transmitter 116 is fired with the third shot captured or received at the plurality of receivers 123 or receiver array 124. For example, a third transmitter 116 may comprise a quadrupole source. The quadrupole source may be fired such that a third one or more signals, for example, a third one or more source signals 118 that generate a third one or more casing waves 120, are generated and subsequently received or captured, for example, as a third one or more echo responses 122, by the monopole receiver, the dipole receiver and the quadrupole receiver. In one or more embodiments, one or more monopole receivers and one or more of one or more dipole (or cross-dipole) receivers, one or more quadrupole (or cross-quadrupole) receivers, any other one or more multi-pole (or cross-multi-pole) receivers and any combination thereof may be utilized to receive the third one or more signals from the quadrupole source.

At step 1008, direct arrivals reduction for received signals, for example, the one or more received echo response 122, is performed, for example, a filter is applied to the received signals to filter or remove noise, which includes one or more of the borehole guided waves and formation refracted waves. For example, a monopole source transmitter may generate a formation refracted compressional wave, a formation refracted shear wave and a Stoneley wave. A dipole transmitter may generate one or more flexural waves. A quadrupole transmitter may generate a screw wave that is a borehole guided mode wave excited by the quadrupole transmitter. As these waves may not be the target of the measurement, these waves should be removed from the raw wave signals by some filter, for example, a frequency-wave number (F-K) filter, transferring the data to the F-K domain, and removing the non-target waves in the F-K domain.

At step 1010, a transmitter azimuth or azimuthal angle is selected. For example, a user may select a first transmitter azimuth or first transmitter azimuthal angle for processing, for example, in step 1012. A user may select a second transmitter azimuth or second transmitter azimuthal angle, or one or more subsequent transmitter azimuths or transmitter azimuthal angles for processing until the 360 degrees of the borehole 102 is covered.

At step 1012, any one or more of the multi-pole sources are rotated. For example, the dipole source and the quadrupole source of steps 1004 and 1006 are digitally rotated to face the selected transmitter azimuth or transmitter azimuthal angle from step 1010. For example, original measurements of the dipole transmitter may be at a transmitter azimuth or transmitter azimuthal angle A and at a transmitter azimuth of or transmitter azimuthal angle of A +90 degrees so as to achieve digital rotation. After each rotation, the one or more measurements or signals, for example, amplitude of the one or more signals is stored. In one or more embodiments, any one or more sources are rotated, digitally or physically. In one or more embodiments, the one or more signals received by one or more receivers or receiver array at each rotation may be weighted. The one or more signals received or the weighted one or more signals received for each rotation are separately summed for each one or more receivers or receiver array as discussed above with respect to step 914 of FIG. 9 and for example, with respect to FIGS. 3 and 4. For example, the modelling discussed above in step 914 yields the tuning effects of the borehole structure which may be in a form of one or more frequency response factors. The one or more frequency response factors comprise one or more complex values of the ratio of the signal inside the casing or the formation and a source function, for example, a pulse function that is used to drive the transmitter 116 for generating one or more acoustic signals in the borehole. In one or more embodiments, a frequency response factor may be determined by taking the ratio of a simulated transmitted wave signal converted into the frequency domain by, for example, a Fourier transform and the source signal associated with source 105 converted to the frequency domain. The simulated transmitted wave signal may be obtained by forward modeling. For example, assuming a set of casing properties, borehole properties or both, using the finite difference method or the real axial integration method to perform a wave field simulation, the simulated transmitted wave signal is obtained by the calculated acoustic pressure field inside the casing or the formation.

Then at the receiver side, the one or more receivers or any one or more receivers of the receiver array may be rotated, for example, digitally rotated, to the target azimuth which is the same as the target azimuth of the transmitter as discussed above with respect to step 918 of FIG. 9. The weighted summation of the received one or more signals at each of the receivers or receiver array, for example, the monopole-captured-field, the dipole-captured-field and the quadrupole-captured-field, are summed. The processing at the transmitter side and the receiver side is performed for each azimuth associated with the transmitter side and the receiver side. For example, a summation of the weighted rotated monopole-source-generated-field, dipole-source-generated-field and quadrupole-source-generated field signals at each specific receiver is performed. Then the summation of the weighted monopole-captured-field, the dipole-captured-field and the quadrupole-captured field (at which the transmitter our source fields have already been combined) is performed.

As an example, a transmitter comprising a transmitter "M" (monopole), a transmitter "D" (dipole), and transmitter "Q" (quadrupole) are disposed or positioned on or about a downhole tool and a plurality of receivers or a receiver array comprises a receiver "m" (monopole), a receiver "d" (dipole) and a receiver "q" (quadrupole) are disposed or positioned on about a downhole. The one or more signals received at the plurality of receivers or the receiver array are observed as $M_m$, Md, Mq, Dm, Dd, Dq, Qm, Qd, and Qq where the first letter represents the source or the transmitter and the second letter represents the receiving receiver. When the transmitters are rotated to a transmitter azimuth or transmitter azimuthal angle (θ), the one or more resulting signals at the plurality of receivers or receiver array are observed as Mm, Md, Mq, $D_\theta m$, $D_\theta d$, $D_\theta q$, $Q_\theta m$, $Q_\theta d$, and $Q_\theta q$. Combining or taking the summation of the one or more received signals observed when the transmitters are rotated to θ ($C_\theta$) may be represented as:

$$C_\theta m = Mm + D_\theta m + Q_\theta m,$$

$$C_\theta d = Md + D_\theta d + Q_\theta d, \text{ and}$$

$$C_\theta q = Mq + D_\theta q + Q_\theta q.$$

When one or more of the plurality of receivers or the one or more receivers of the receiver array are rotated to a receiver azimuth or a receiver azimuthal angle (θ), the one or more signals are observed as $C_\theta m_\theta$, $C_\theta d_\theta$, $C_\theta q_\theta$. Combining or taking the summation of the one or more received signals observed when the one or more of the plurality of receivers or the one or more receivers of the receiver array are rotated to θ ($C_\theta c_\theta$) may be represented as:

$$C_\theta c_\theta = C_\theta m_\theta + C_\theta d_\theta + C_\theta q_\theta.$$

$C_\theta c_\theta$ is the final summed or resulting one or more signals. In one or more embodiments, the summation of the transmitter rotated signals ($C_\theta$) is optional, for example, where the source is a leak behind the casing, and thus the leak source is $C_\theta$ and no summation is required on the source or transmitter side. In one or more embodiments, the transmitter azimuth or transmitter azimuthal angle may be different from or the same as the receiver azimuth or receiver azimuthal angle.

The effects of the borehole structure are removed by dividing the one or more frequency response factors by the one or more recorded signals in the frequency domain. The decoupling, decouple the borehole/casing tuning effects, is performed for the monopole transmitter, the dipole transmitter and the quadrupole transmitter, separately. For each azimuth or azimuthal angle at which the transmitter is oriented, an associated wave field is calculated. As the monopole source (for example, from the transmitter 116), denoted by $S_{MP}(t)$, radiates sound equally well in all directions, rotation of the monopole source is not required. Dipole and quadrupole sources (for example, from the transmitter 116) may be digitally rotated to different azimuth or azimuthal angle based, at least in part, on at least two firings oriented to different azimuths or one or more different azimuthal angles. For example, assuming a cross-dipole measurement is made at a first transmitter azimuth X and a second transmitter azimuth Y, denoted by $S_{DP-X}$ and $S_{DP-Y}$, to get the signal at a third transmitter azimuth or transmitter azimuthal angle, which has an angle of θ to X, the below Equation may be used to rotate the quadrupole firing:

$$S_{DP-\theta}(t)=S_{DP-X}(t)\cos\theta+S_{DP-Y}(t)\sin\theta \quad \text{Equation 2.}$$

For example, assuming a cross-quadrupole measurement is made at a first transmitter azimuth $X_1$ and $X_2$, denoted by $S_{QP-X1}$ and $S_{QP-X2}$, to get the signal at a third transmitter azimuth or transmitter azimuthal angle, which has an angle of θ to $X_1$, the equation below to rotate the quadrupole firing, $$S_{QP-\theta}(t)=S_{QP-X1}(t)\cos 2\theta+S_{QP-X2}(t)\sin 2\theta \quad \text{Equation 3.}$$

The one or more signals are synthesized with the monopole, dipole and quadrupole firings to obtain the final one or more signals, $$S_{\theta}(t)=S_{MP}(t)+S_{DP-\theta}(t)+S_{QP-\theta}(t) \quad \text{Equation 4.}$$

Equations 2-3 may be performed for each transmitter azimuth or transmitter azimuthal angle for each of the one or more receivers.

At step 1014, the multi-pole receivers are rotated to ensure that any one or more received signals are from the selected receiver azimuth or receiver azimuthal angle. For example, the dipole receiver and quadrupole receiver, for example, are digitally rotated to a receiver azimuth or receiver azimuthal to face the selected transmitter azimuth or transmitter azimuthal angle from step 1010 such that the receiver and transmitter azimuthal angles are the same. After each rotation, the amplitude of each signal received at the selected transmitter azimuth or transmitter azimuthal angle (for example, Amp (θ)) and the summation of the received signals is stored or recorded, for example, as discussed above with respect to FIG. 9. The combined waveforms for the monopole receiver, each dipole receiver, each quadrupole receiver, any other receivers are calculated or determined with the workflow of FIG. 9 used to further enhance the azimuthal resolution.

In one or more embodiments, after step 1014, the method proceeds to step 1010 and another transmitter azimuth or transmitter azimuthal angle is selected. In this way, the method scans the borehole with the one or more transmitters disposed or positioned at a second transmitter azimuth or transmitter azimuthal angle with the one or more receivers or receiver array subsequently rotated to a second receiver azimuth or receiver azimuthal angle. In one or more embodiments, the method continues to loop to step 1010 until all transmitter azimuths or transmitter azimuthal angles are scanned.

At step 1016, any one or more of an azimuthal image of the borehole 102, casing 106, information associated with the cement 110, any other downhole characteristic and any combination thereof is generated based, at least in part, on the final calculated signals. In one or more embodiments, the azimuthal image generated at step 1016 may be displayed on a display, such as display 142 of information handling system 132, may be interpreted or processed by an information handling system such as information handling system 132, may be generated by the information handling system, and any combination thereof. For example, if the receiver is a monopole receiver, the one or more final signals are the combined waves of step 1014 and if the receiver includes monopole, dipole, quadrupole, any other receiver and any combination thereof the method of FIG. 9 provides the calculated signal. In one or more embodiments, a modelling function generated from modelling data may be utilized to determine a cement-bond characteristic or condition, for example, according to Equation 5:

$$BC(\theta)=f(Amp(\theta)) \quad \text{Equation 5.}$$

Figure 11:
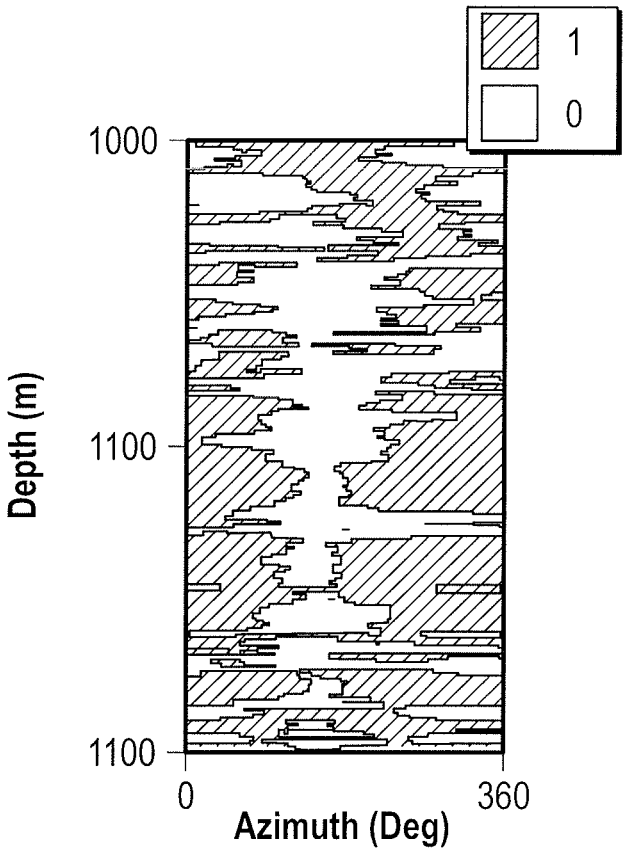
FIG. 11 is an illustration of a cement-bond condition of a casing in a borehole, according to one or more aspects of the present disclosure.

BC is the cement-bond condition or characteristic and $f(\ )$ is the modelling function, for example, a library or an empirical function used to connect a value of an amplitude, a value of an attenuation or both to one or more cement-bond condition values. The modelling function $f$ may be generated by processing the synthetic data. For example, a list of one or more borehole models, one or more casing models or both with finite difference method, where the BC (θ) is known for each of the models. Processing the synthetic data with the discussed above approach yields amplitude values of Amp (θ). The pairs of BC (θ) and Amp (θ) to a hard disk as a library or generate an empirical function based on the pairs. The one or more amplitudes at each of the one or more angles θ, may be processed using Equation 5 by looking at the library or using an empirical function. For example, a cement-bond map is illustrated in FIG. 11 where "1" denotes a cement-bond with sufficient or good integrity and a "0" denotes no cement-bond or a cement-bond with insufficient integrity. The vertical axis in FIG. 11 denotes depth in meters (m) while the horizontal access denotes Azimuth in degrees (Deg). In one or more embodiments, a user, such as an engineer, may evaluate a cement-bond condition or characteristic (BC) and based, at least on in part this evaluation may determine the need to perform or cause to be performed one or more additional operations. For example, if the BC does not meet or exceed a threshold, an operation may be performed to ensure casing integrity and zone isolation. In one or more embodiments, the cement-bond map of FIG. 11 may be displayed on a display, such as display 142 of information handling system 132, or may be interpreted or processed by an information handling system such as information handling system 132.

In one or more embodiments, the first, second and third transmitters may be the same transmitter or distinct transmitters. For example, the first shot, second shot and third shot may be generated by a single transmitter 116 that has the function of firing a monopole, a dipole, a quadrupole and any combination thereof. A single transmitter 116 may comprise eight elements which are azimuthally located in a circle. The implementation of a monopole transmitter, a cross-dipole transmitter and a cross-quadrupole transmitter may be realized with eight source elements positioned 45 degrees apart at the same depth but different azimuth planes. A monopole transmitter signal may be generated by firing the eight elements with the same drive pulse function, the dipole transmitter signals are generated by firing the opposite elements with out of phase drive pulse, and the quadrupole transmitter signals are generated by firing one pair of opposite receivers with a positive pulse and the other pair of opposite receivers with a negative pulse. The weights from these firings associated with the monopole, dipole and quadrupole transmitters can be calculated and summed together for each element. The firing of all the elements with a drive pulse multiplied by the calculated weights yields the field by the combined sources.

In one or more embodiments, any one or more steps of FIG. 10 may be omitted or repeated and may be performed in a different order. In one or more embodiments, data, one or more measurements, and information obtained from the plurality of receivers 123 or receiver array 124 may be stored downhole, for example, in memory 125 of the downhole tool 112, with processing of the data, one or more measurements and information performed at the surface 108, for example, by information handling system 132.

In one or more embodiments, a method for determining a cement-bond condition comprises rotating a source of a downhole tool to a plurality of azimuthal angles, at each rotation, receiving, by the plurality of receivers, one or more signals associated with a source, wherein the plurality of receivers comprise one or more monopole receivers and one or more multipole receivers, and wherein the one or more monopole receivers receive the one or more signals as one or more monopole measurements and the one or more multipole receivers receive the one or more signals as one or more multipole measurements, determining an amplitude of the one or more signals at each receiver azimuthal angle of the plurality of receiver azimuthal angles, and determining a cement-bond condition of a casing of a borehole based, at least in part, on the amplitude. In one or more embodiments, the method further comprises storing in a memory of the downhole tool one or more of the one or more monopole measurements and the one or more multi-pole measurements. In one or more embodiments, the method further comprises applying a pre-filter to the one or more signals to filter out an interference of a guided wave in a borehole. In one or more embodiments, the source comprises a first transmitter, a second transmitter and a third transmitter. In one or more embodiments, the first transmitter comprises a monopole, the second transmitter comprises a cross-dipole source and the third transmitter comprises a quadrupole source. In one or more embodiments, the method further comprises rotating the second transmitter and the third transmitter to one or more transmitter azimuthal angles to generate one or more resulting signals, summing the one or more resulting signals received at the plurality of receivers rotated to a first receiver azimuthal angle of the plurality of receiver azimuthal angles and determining a resulting amplitude of the one or more resulting signals, wherein the cement-bond condition is based, at least in part, on the resulting amplitude. In one or more embodiments, one or more of the multipole receivers comprises one or more of a dipole receiver and a quadrupole receiver. In one or more embodiments, a non-transitory computer readable medium storing one or more instructions that, when executed by a processor, cause the processor to perform one or more of the above method steps.

In one or more embodiments, a downhole tool disposable within a borehole comprises a source rotatable to a plurality of azimuthal angles, a plurality of receivers rotatable to one or more receiver azimuthal angles, wherein the plurality of receivers receive one or more signals from the source at each of the plurality of receiver azimuthal angles, wherein the plurality of receivers comprise one or more monopole receivers and one or more multipole receivers, and wherein the one or more monopole receivers receive the one or more signals as one or more monopole measurements and the one or more multipole receivers receive the one or more signals as one or more multipole measurements, a memory coupled to the plurality of receivers, wherein the memory stores one or more amplitudes associated with the one or more signals from the source at each of the plurality of receiver azimuthal angles for determining a cement-bond condition associated with a casing of the borehole. In one or more embodiments, the source comprises a first transmitter, a second transmitter and a third transmitter. In one or more embodiments, each of the first transmitter, the second transmitter and the third transmitter are oriented at different azimuthal angles from each other. In one or more embodiments, the first transmitter comprises a monopole, the second transmitter comprises a cross-dipole source and the third transmitter comprises a quadrupole source. In one or more embodiments, the second transmitter and the third transmitter are rotatable to the one or more source azimuthal angles and generate one or more resulting signals at each of the one or more source azimuthal angles, the monopole receiver and the multipole receiver receive the one or more resulting signals rotated to a first receiver azimuthal angle of the one or more receiver azimuthal angles, and the memory stores one or more resulting amplitudes for determining the cement-bond condition. In one or more embodiments, one or more of the multipole receivers comprises one or more of a dipole receiver and a quadrupole receiver.

In one or more embodiments a method for determining a location of a downhole signal source comprises receiving, by a plurality of receivers, one or more signals associated with a signal source, wherein the plurality of receivers comprise one or more monopole receivers and one or more multipole receivers, and wherein the one or more monopole receivers receive the one or more signals as one or more monopole measurements and the one or more multipole receivers receive the one or more signals as one or more multipole measurements, applying a signal processing technique to one or more of the one or more monopole measurements and the one or more multipole measurements to obtain one or more processed measurements, determining a radial position and a depth position of the signal source based, at least in part, on the one or more processed measurements, combining the one or more processed measurements to obtain one or more receiving patterns, extracting an amplitude of the one or more receiving patterns with azimuth, determining a source azimuth associated with a maximum received signal of the one or more processed measurements at a downhole tool depth and determining the location of the signal source based, at least in part, on the source azimuth, the radial position and the depth position. In one or more embodiments the method further comprises storing in a memory of the downhole tool one or more of the one or more monopole measurements and the one or more multi-pole measurements. In one or more embodiments, the method further comprises applying a pre-filter to the one or more signals to filter out an interference of a guided wave in a borehole. In one or more embodiments, the one or more signals are associated with one or more characteristics of one or more of a downhole leak and a cement-bond of a casing of a borehole. In one or more embodiments, the method further comprises one or more of phase-tuning of the borehole structure on the one or more of the one or more monopole measurements and the one or more multipole measurements and amplitude-tuning of the borehole structure on the one or more of the one or more monopole measurements and the one or more multipole measurements. In one or more embodiments, the method further comprises rotating one or more of the plurality of receivers. In one or more embodiments, one or more of the multipole receivers comprises one or more of a dipole receiver and a quadrupole receiver. In one or more embodiments, the method comprises generating a first shot by a transmitter of the downhole tool, wherein the plurality of receivers receive one or more first resulting signals of the first shot and generating a second shot by the transmitter, wherein the plurality of receivers receive one or more second resulting signals of the second shot. In one or more embodiments, a non-transitory computer readable medium storing one or more instructions that, when executed by a processor, cause the processor to perform any one or more steps of the method steps. In one or more embodiments, a downhole tool disposable within a borehole comprises the plurality of receivers, a memory that stores one or more instructions and a processor that executes the one or more instructions to perform any one or more of the method steps. In one or more embodiments, the downhole tool communicates with an information handling system at a surface wherein the information handling system performs one or more steps of the method.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (for example, "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method for determining a cement-bond condition comprising:

digitally rotating one or more receivers of a plurality of receivers of a downhole tool to obtain 360 degrees of coverage of a borehole at a plurality of receiver azimuthal angles;

at each rotation, receiving, by the plurality of receivers, one or more signals associated with a source, wherein the plurality of receivers comprise one or more monopole receivers and one or more multipole receivers, and wherein the one or more monopole receivers receive the one or more signals as one or more monopole measurements and the one or more multipole receivers receive the one or more signals as one or more multipole measurements;

computing a weighted sum of the one or more signals received at the plurality of receivers rotated to a first receiver azimuthal angle of the plurality of receiver azimuthal angles;

determining an amplitude of the weighted sum of the one or more signals at each receiver azimuthal angle of the plurality of receiver azimuthal angles; and determining a cement-bond condition of a casing of the borehole based, at least in part, on the amplitude.

2. The method of claim 1, further comprising storing in a memory of the downhole tool one or more of the one or more monopole measurements and the one or more multipole measurements.

3. The method of claim 1, further comprising applying a pre-filter to the one or more signals to filter out an interference of a guided wave in a borehole.

4. The method of claim 1, wherein the source comprises a first transmitter, a second transmitter and a third transmitter.

5. The method of claim 4, wherein the first transmitter comprises a monopole, the second transmitter comprises a cross-dipole source and the third transmitter comprises a quadrupole source.

6. The method of claim 5, further comprising:

rotating the second transmitter and the third transmitter to one or more transmitter azimuthal angles to generate one or more resulting signals;

determining a resulting amplitude of the one or more resulting signals, wherein the cement-bond condition is based, at least in part, on the resulting amplitude; and extracting the azimuth of the one or more resulting signals based at least in part on the resulting amplitude of the one or more resulting signals.

7. The method of claim 1, wherein one or more of the multipole receivers comprises one or more of a dipole receiver and a quadrupole receiver.

8. A downhole tool disposable within a borehole, comprising:

a source rotatable to a plurality of source azimuthal angles;

a plurality of receivers, wherein the plurality of receivers are digitally rotatable to obtain 360 degrees of coverage of the borehole at one or more receiver azimuthal angles, wherein the plurality of receivers receive one or more signals from the source at each of the one or more receiver azimuthal angles, wherein the plurality of receivers comprise one or more monopole receivers and one or more multipole receivers, and wherein the one or more monopole receivers receive the one or more signals as one or more monopole measurements and the one or more multipole receivers receive the one or more signals as one or more multipole measurements; and a memory coupled to the plurality of receivers, wherein the memory stores one or more amplitudes associated with the one or more signals from the source at each of the one or more receiver azimuthal angles, wherein the memory stores a weighted sum of the one or more signals received at the plurality of receivers rotated to a first receiver azimuthal angle of the one or more receiver azimuthal angles; wherein the one or more amplitudes comprise one or more amplitudes of the weighted sum of the one or more signals; and wherein a cement-bond condition associated with a casing of the borehole is determinable using the one or more amplitudes.

9. The downhole tool of claim 8, wherein the source comprises a first transmitter, a second transmitter and a third transmitter.

10. The downhole tool of claim 9, wherein the first transmitter comprises a monopole, the second transmitter comprises a cross-dipole source and the third transmitter comprises a quadrupole source.

11. The downhole tool of claim 9, further comprising:

wherein the second transmitter and the third transmitter are rotatable to the plurality of source azimuthal angles and generate one or more resulting signals at each of the plurality of source azimuthal angles;

wherein the monopole receiver and the multipole receiver receive the one or more resulting signals rotated to a first receiver azimuthal angle of the one or more receiver azimuthal angles; and wherein the memory stores one or more resulting amplitudes for determining the cement-bond condition.

12. The downhole tool of claim 8, wherein one or more of the multipole receivers comprises one or more of a dipole receiver and a quadrupole receiver.

13. The downhole tool of claim 8, wherein the source is digitally rotated.

14. A non-transitory computer readable medium storing one or more instructions that, when executed by a processor, cause the processor to:

digitally rotate one or more receivers of a plurality of receivers of a downhole tool to obtain 360 degrees of coverage of a borehole at a plurality of receiver azimuthal angles;

at each rotation, receive, by the plurality of receivers, one or more signals associated with a source, wherein the plurality of receivers comprise one or more monopole receivers and one or more multipole receivers, and wherein the one or more monopole receivers receive the one or more signals as one or more monopole measurements and the one or more multipole receivers receive the one or more signals as one or more multipole measurements;

compute a weighted sum the one or more signals received at the plurality of receivers rotated to a first receiver azimuthal angle of the plurality of receiver azimuthal angles;

determine an amplitude of the weighted sum of the one or more signals at each azimuthal angle of the plurality of receiver azimuthal angles; and determine a cement-bond condition of a casing of a borehole based, at least in part, on the amplitude.

15. The non-transitory computer readable medium of claim 14, wherein the one or more instructions that, when executed by the processor, further cause the processor to store in a memory of the downhole tool one or more of the one or more monopole measurements and the one or more multipole measurements.

16. The non-transitory computer readable medium of claim 14, wherein the one or more instructions that, when executed by the processor, further cause the processor to apply a pre-filter to the one or more signals to filter out an interference of a guided wave in a borehole.

17. The non-transitory computer readable medium of claim 14, wherein the source comprises a first transmitter, a second transmitter and a third transmitter.

18. The non-transitory computer readable medium of claim 17, wherein the first transmitter comprises a monopole, the second transmitter comprises a cross-dipole source and the third transmitter comprises a quadrupole source.

19. The non-transitory computer readable medium of claim 17, wherein the one or more instructions that, when executed by the processor, further cause the processor to:

rotate the second transmitter and the third transmitter to one or more transmitter azimuthal angles to generate one or more resulting signals; and determine a resulting amplitude of the one or more resulting signals, wherein the cement-bond condition is based, at least in part, on the resulting amplitude; and extracting the azimuth of the one or more resulting signals based at least in part on the resulting amplitude of the one or more resulting signals.

20. The non-transitory computer readable medium of claim 14, wherein one or more of the multipole receivers comprises one or more of a dipole receiver and a quadrupole receiver.

* * * * *